US005638618A

United States Patent [19]

Niemela et al.

[11] Patent Number: 5,638,618

[45] Date of Patent: Jun. 17, 1997

[54] ADJUSTABLE WING PLOW

[75] Inventors: Cal G. Niemela, Chassell; Eward R. Lahti; Terry L. Lahti, both of Houghton, all of Mich.

[73] Assignee: Blizzard Corporation, Calumet, Mich.

[21] Appl. No.: 664,325

[22] Filed: Jun. 7, 1996

[51] Int. Cl.[6] ..... E01H 5/06

[52] U.S. Cl. ..... 37/281; 37/283; 37/234; 37/279; 37/903; 172/815; 172/782

[58] Field of Search ..... 37/241, 281, 282, 37/283, 234, 232, 236, 266, 903, 409, 279; 172/782, 786, 815, 816, 684.5

[56] References Cited

U.S. PATENT DOCUMENTS

| | | | |
|---|---|---|---|
| Re. 31,045 | 10/1982 | Essell et al. | 37/281 |
| 1,927,078 | 9/1933 | Weeks | 37/44 |
| 2,218,512 | 10/1940 | Ball | 37/42 |
| 2,299,451 | 10/1942 | Austin | 37/44 |
| 2,410,543 | 11/1946 | Kester | 37/44 |
| 2,524,329 | 10/1950 | Richardson | 37/44 |
| 3,250,026 | 5/1966 | Jocher et al. | 37/42 |
| 3,302,317 | 2/1967 | Domres | 37/179 |
| 3,425,497 | 2/1969 | Strabala et al. | 172/786 |
| 3,430,706 | 3/1969 | Marron | 172/802 |
| 3,477,151 | 11/1969 | Zanella | 37/42 |
| 3,657,828 | 4/1972 | Anderson | 37/46 |

(List continued on next page.)

FOREIGN PATENT DOCUMENTS

| | | |
|---|---|---|
| 140139 | 5/1985 | European Pat. Off. . |
| 323974 | 5/1970 | Sweden . |

OTHER PUBLICATIONS

*Farm Industry News*, vol. 23, No. 7, Jul./Aug. 1990, p. 25.

Publication "Still Out Front in Productivity," Excel Industries, Inc., © 1988.

"Snow Track 440," Publication, Excel Industries, 1989.

Snow Craft Industries, Inc. Publication, Sedalla, Colorado, published more than one year prior to the filing date of this application.

*Primary Examiner*—Randolph A. Reese
*Assistant Examiner*—Thomas A. Beach
*Attorney, Agent, or Firm*—Van Dyke, Gardner, Linn & Burkhart, LLP

[57] ABSTRACT

A plow assembly is disclosed for vehicles such as pickup trucks and tractors for moving snow or other materials. The plow assembly has at least one extendable, forwardly pivotable plow wing which is extendable on one end of a main plow by sliding movement along the front of the plow between a retracted and an extended position in which the plow wing is generally aligned with the plow front surface. The plow wing is also pivotally mounted on a hinge for movement between the extended position and a forwardly angled position in which the plow wing front surface extends at an angle to the plow front surface. A power source connected to the plow wing is operable to move the wing between the retracted, extended and forwardly angled positions. Preferably, a latch assembly prevents pivotal movement of the plow wing to the forwardly angled position until the plow wing is in the extended position. In the preferred embodiment, an extendable plow wing is included on each end of the main plow with a pair of independent fluid cylinders connected to the respective plow wings which are operable independently of one another to move the plow wings independently between their respective retracted, extended and forwardly angled positions. When both plow wings are pivoted to their forwardly angled positions, the plow assembly has a general U-shape which facilitates pushing snow or other material without the snow slipping off the plow blade ends. The plow assembly is also preferably pivotally mounted on a support frame for movement about a generally vertical pivot axis from a centered position to a series of angled positions in which the plow blade is angled to the left or right of the centered position. If desired, the plow blade may be pivotally connected to the support frame about a second, generally horizontal pivot axis to allow forward pivotal movement of the plow blade and plow wings in unison when the plow blade or either wing encounters an obstacle during plowing.

51 Claims, 13 Drawing Sheets

U.S. PATENT DOCUMENTS

| | | | |
|---|---|---|---|
| 3,775,877 | 12/1973 | Gove, Sr. | 37/42 |
| 3,803,733 | 4/1974 | Ramsey | 37/44 |
| 3,807,064 | 4/1974 | Schmidt, Jr. | 37/41 |
| 4,019,268 | 4/1977 | Waterman | 37/10 |
| 4,073,077 | 2/1978 | Essel et al. | 37/50 |
| 4,074,448 | 2/1978 | Niemela | 37/41 |
| 4,099,578 | 7/1978 | Stevens | 172/802 |
| 4,145,825 | 3/1979 | Bertolino | 37/42 |
| 4,196,532 | 4/1980 | Muller | 37/105 |
| 4,249,323 | 2/1981 | Mathis et al. | 37/42 |
| 4,275,514 | 6/1981 | Maura | 37/42 |
| 4,356,645 | 11/1982 | Hine et al. | 37/281 |
| 4,369,847 | 1/1983 | Mizunuma | 172/815 |
| 4,372,617 | 2/1983 | Zamboni | 172/782 X |
| 4,479,312 | 10/1984 | Turgeon | 31/219 |
| 4,614,048 | 9/1986 | Melby | 37/280 |
| 4,658,519 | 4/1987 | Quenzi | 37/23 |
| 4,667,426 | 5/1987 | Howard et al. | 37/232 |
| 4,723,609 | 2/1988 | Curtis | 172/815 |
| 4,779,363 | 10/1988 | Boutrais et al. | 37/117 |
| 4,834,191 | 5/1989 | Vecchio | 172/784 |
| 4,962,600 | 10/1990 | Zellaha et al. | 37/280 |
| 5,165,191 | 11/1992 | Davis | 37/409 |
| 5,285,588 | 2/1994 | Niemela et al. | 37/234 |
| 5,375,349 | 12/1994 | Jochim | 37/429 |
| 5,392,538 | 2/1995 | Geerligs et al. | 37/268 |
| 5,411,102 | 5/1995 | Nickels et al. | 172/781 |
| B1 4,356,645 | 11/1984 | Hine et al. | 37/281 |

ADJUSTABLE WING PLOW

FIELD OF THE INVENTION

This invention relates to plows fitted on vehicles for moving snow and other materials and, more particularly, to a plow for snow and other materials for use with pickup trucks and other vehicles having plow wings which are individually adjustable for both extension of the main plow and forward angling for positioning the plow to prevent snow or other plowed material from slipping off the ends of the plow.

BACKGROUND OF THE INVENTION

A wide variety of snow plows for pickup trucks and other utility vehicles are available and in use. These include straight bladed plows of the type shown in U.S. Pat. No. 3,250,026, and center-hinged, V-plows of the type shown in U.S. Pat. Nos. 4,074,448 and 4,658,519. Other straight bladed plows have been devised with one or both ends being slidably extendable as shown in U.S. Pat. No. 2,218,512; U.S. Pat. No. 3,807,064; and Swedish 323,974. Yet other plows have included straight blades with pivotable, non-extendable ends as shown in U.S. Pat. Nos. 4,145,825 and 3,477,151. At least one plow is shown in EPO 140,139 having permanently forwardly angled plow ends, which forwardly angled plow ends include slidable extensions wherein the entire plow swings from side to side so as to angle the entire plow left or right.

While each of the above types of prior known plows is useful in one or more situations, the overall flexibility for use of these plows has been limited. For example, for pickup truck mounted snow plows which must be transported from one snow clearing site to another, it is necessary that the plow be short enough to allow transport on public highways which have limited lane width. However, when actually engaged in plowing, it is very helpful to have a greater length for the plow so that larger areas of the parking lot or other site can be cleared of snow more quickly. Yet another problem encountered is when large amounts of snow must be pushed or carried with the plow from one area of a clearing site to another such as the side of a parking lot. Many of the above mentioned plows allow snow or other material being cleared to slip off the ends of the plow thereby requiring additional time and work to completely clear the site.

Existing, prior known plows have, therefore, failed to provide a plow with sufficient flexibility to handle the varying needs encountered in plowing using pickup trucks or other vehicles, especially when such vehicles must be driven on public highways. Such needs include a short enough plow length to allow transportation on public highways, a long enough length for fast, efficient clearing of a job site, and the carrying or pushing of snow from one area to another without allowing snow or other material to slip off the plow ends. All of these results should be accomplished while minimizing the size and space required for the plow in each of its arrangements.

SUMMARY OF THE INVENTION

Accordingly, the present invention provides a plow having adjustable wings on its ends which can be adjusted to varying positions to allow transport on public highways, to provide increased plow length for fast, efficient clearing of snow or other material being plowed, and to allow carrying or pushing of snow from one area to another without the snow or other plowed material slipping off the plow ends. The present plow may be configured in various arrangements to handle each of these situations while minimizing the size and space required by the plow when in position on the vehicle. The present plow also allows adjustment to meet these various situations from a remote position in the cab of the vehicle without external, hands on adjustment.

In one form, the invention is a plow assembly for vehicles for plowing snow or other materials. The assembly includes a plow having first and second ends, a front material engaging surface and a rear surface opposite the front surface. A support is included for attaching the plow blade to the vehicle. An extendable plow wing is included on the first end of the plow. The plow wing has inner and outer ends, a front, material engaging surface, and a rear surface opposite the front surface. The plow wing is mounted for sliding movement along the front surface of the plow at the first end between a retracted position in which the outer end of the plow wing is adjacent the first end of the plow blade, and an extended position in which the outer wing end is spaced outwardly of the first end of the plow blade with the plow wing front surface generally aligned with the plow front surface. The plow wing includes a hinge. The plow wing is pivotally mounted on the hinge for movement between the extended position and a forwardly angled position in which the wing front surface extends at an angle to the plow front surface. A power source is connected to the plow wing and is operable to move the wing between its retracted, extended and forwardly angled positions.

In a preferred form of the invention, the plow assembly includes a pair of extendable plow wings. A first wing is mounted for sliding movement along the front surface of the plow at a first end of the plow. The second wing is mounted for sliding movement along the front surface of the plow at the second plow end. Each of the plow wings is moveable between a retracted position and an extended position in which the wings are generally aligned with the plow front surface. Each wing is also pivotally mounted on a hinge for movement between the extended position and a forwardly angled position in which each from wing surface extends at an angle to the plow front surface. A power source is operable to move each of the plow wings independently of the other plow wing such that the plow wings are independently movable between their respective retracted, extended and forwardly angled positions. The plow wings form a general U-shape with the plow when both plow wings are in their forwardly angled positions to facilitate pushing snow or other material being plowed without such material slipping off the plow ends.

In other aspects of the invention, each plow wing may include a latch assembly which prevents pivotal movement of the plow wing to the forwardly angled position until the plow wing is in its extended position. Further, each plow wing is preferably mounted on a slide, the plow wing hinge and latch assembly all being mounted on and movable with the slide. The slide is telescopically mounted within a slide support on the rear surface of the plow with the plow including an opening through which the hinge extends to support the plow wing for sliding movement along the front surface of the plow. When in the extended and forwardly angled positions, the slides cover the openings through the plow to allow continued movement of the snow or other material being plowed along the plow front surface.

In yet other aspects of the invention, a stop is included on one of the slides and its surrounding slide support or housing and an aperture on the other of the slide and housing. The aperture includes opposing ends with the stop engaging one of the ends when the plow wing is in the retracted position and the other of the ends when the plow wing is in its extended position.

Movement of the plow wings is preferably made by a pair of extendable, fluid power cylinders, one end of each fluid cylinder pivotally connected to the rear surface of the main plow, and the other end of the fluid cylinder pivotally connected to the hinge. The fluid cylinder is preferably connected to the hinge at a distance from the pivot axis of the hinge so that movement of the plow wing to its forwardly angled position will result after the slide reaches its fully extended position.

In yet further aspects of the invention, the plow assembly preferably is pivotally mounted on a support frame adapted for attachment to the front of a pickup truck or other vehicle. A generally vertical pivot axis allows movement of the plow and plow wings from a centered position to various angled positions to the left or right, regardless of whether one or both of the plow wings are angled forwardly or are aligned with the plow. Also included is a generally horizontal pivot connection between the plow and support frame to allow forward pivotal movement of the plow and plow wings in unison when the plow or wings encounter an obstacle during plowing. Further, biasing means and a shock absorber extend between the plow and an intermediate support for urging the plow and plow wings to an upright, generally vertically oriented position about the horizontal pivot axis. In addition, the fluid power cylinders preferably overlap with one another along the rear of the plow so as to maintain the overall length of the plow assembly sufficiently short for travel on public highways.

Accordingly, the present plow assembly provides numerous advantages over prior known plows. The present plow has sufficient flexibility to handle varying needs including being short enough in length when not extended to allow transport on public highways without projecting into adjacent lanes, can be extended to a sufficient length to allow fast, efficient clearing of snow or other material being plowed from a large area, and yet can be configured with either one or both the extendable ends angled forwardly for highly efficient carrying and/or pushing of snow from one location in the area being plowed to another without the snow or other plowed material slipping off the plow ends. All of these functions are accomplished in the present plow with a minimal size and space due to its compact and efficient construction. The plow may be centered for pushing or carrying of snow, or angled to one side or the other for moving snow or other material to the side of the vehicle supporting the plow. One or both plow wings at the ends of the plow may be extended or pivoted forwardly independently or together, while the entire plow may be centered or angled to one side or the other with one or both of the plow wings extended or pivoted forwardly. In either case, the plow wings at either end of the main plow are independently extendable and movable to a forwardly angled position via remote control from the cab of the vehicle by means of hydraulic fluid cylinders mounted along the back of the plow. In addition, both the main plow and the extendable wings pivot forwardly on a horizontal axis in the event an obstacle is encountered during plowing. Further, when the plow wings are extended, if the vehicle is moved in reverse and a quantity of snow or other material being plowed engages the rear surface of either plow wing, the latch mechanism used in the preferred embodiment of the invention maintains the plow wing in alignment with the plow blade and prevents movement to the forwardly angled position until desired. In addition, the extendable, adjustable plow of the present invention has been designed in a highly compact, lightweight manner allowing use on a wide variety of pickup trucks, utility vehicles, tractors and other vehicles as well, including bulldozers. It may be supported at the front of a vehicle via the preferred support frame or by means such as vertical supports positioned behind the plow assembly such as in a road grader. In addition, the plow assembly of the present invention is rugged, strong and highly durable to allow use in harsh weather or environmental conditions over an extended period of time.

These and other objects, advantages, purposes and features of the invention will become more apparent from a study of the following description taken in conjunction with the drawings.

DESCRIPTION OF THE PREFERRED EMBODIMENTS

Figure 16:
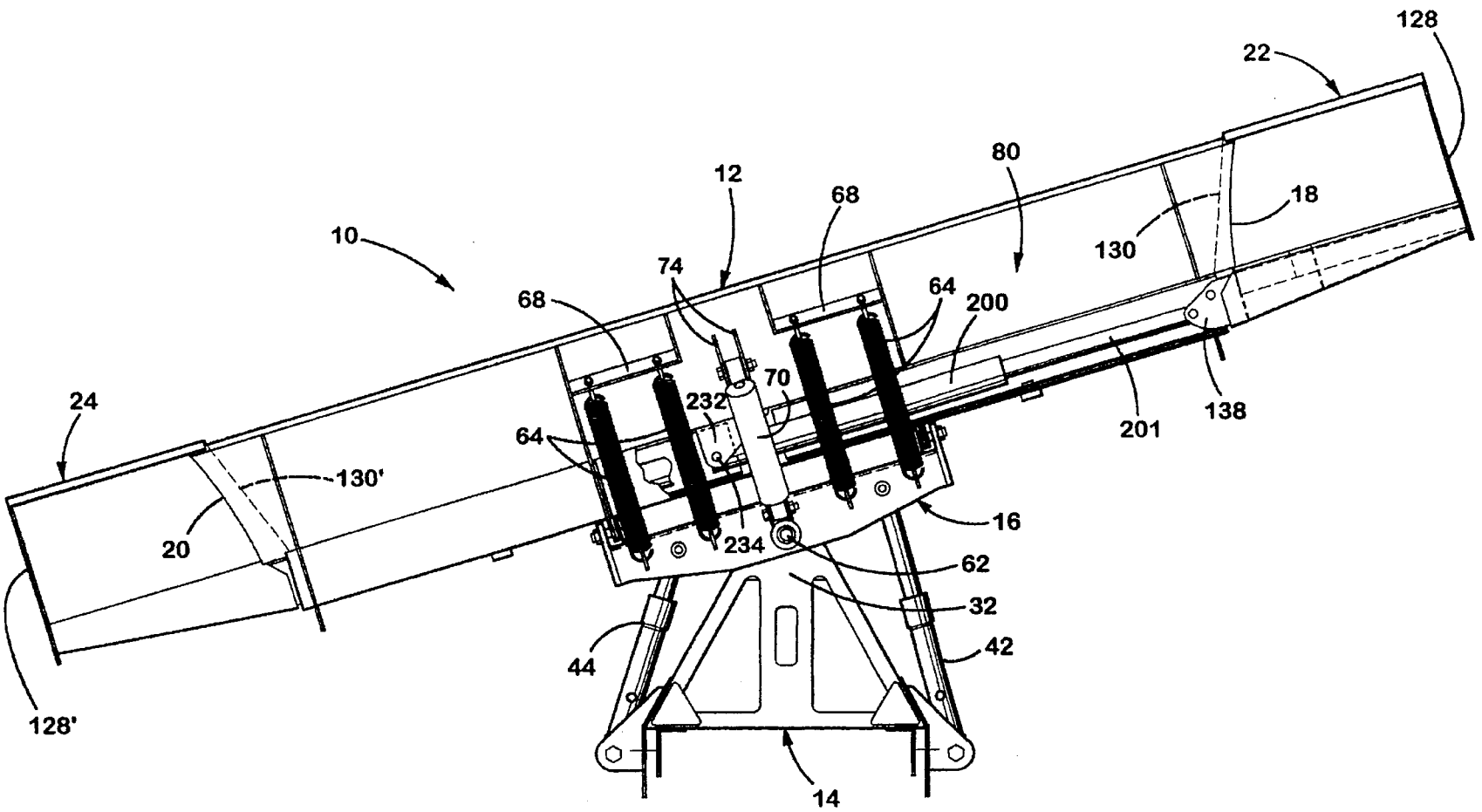
FIG. 16 is a top plan view of the plow assembly of the present invention with the plow wings extended and the plow angled to the left on its support frame.
Figure 17:
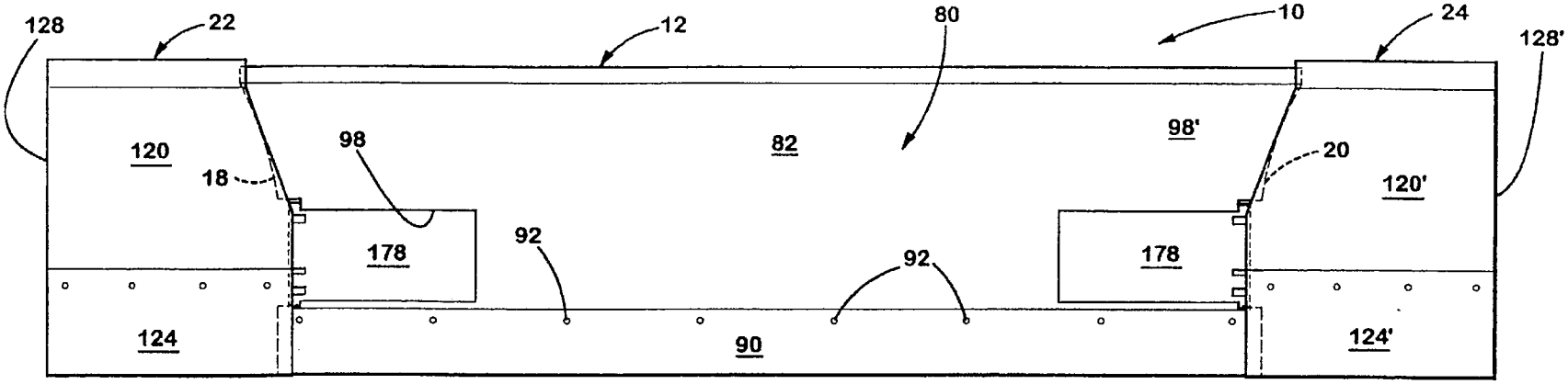
FIG. 17 is a front elevation of the plow assembly of FIG. 16 with the plow wings extended.
Figure 18:
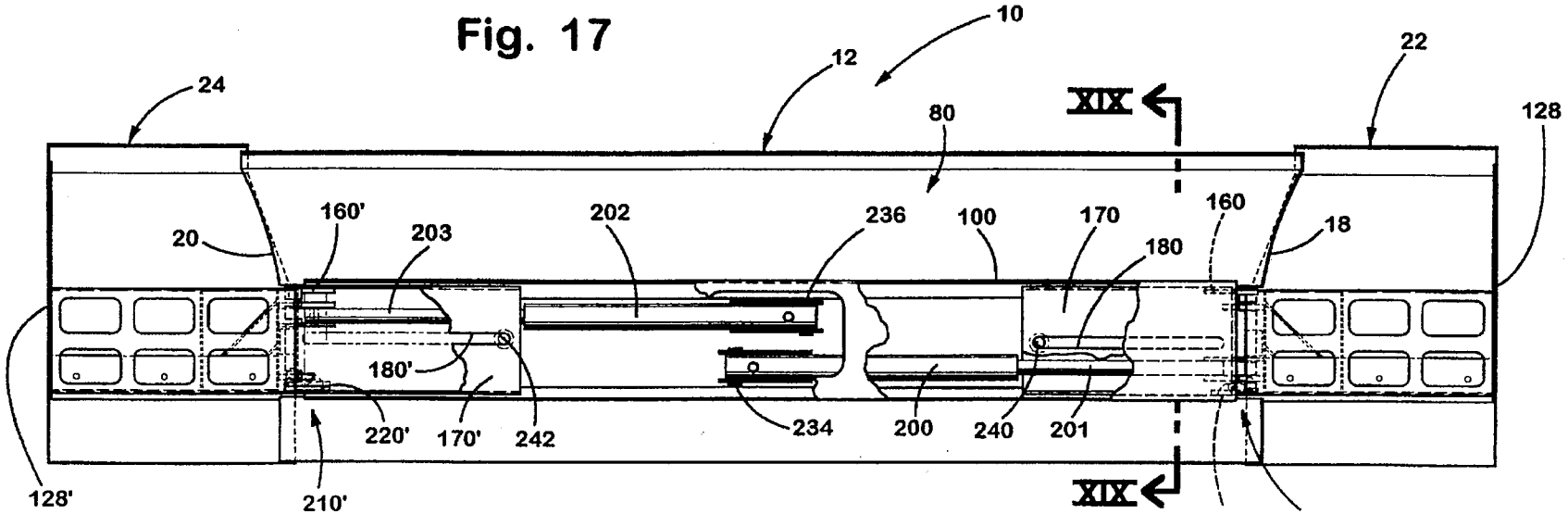
FIG. 18 is a rear elevation of the plow assembly of FIGS. 16 and 17.

Referring now to the drawings in greater detail, a preferred embodiment 10 of the adjustable wing plow assembly of the present invention includes a reinforced main plow 12 pivotally mounted on a support frame 14 via an intermediate support 16. Slidably mounted at opposite ends 18, 20 of main plow 12 are extendable plow wings 22, 24 which are moved by fluid power cylinders 200, 202 remotely controlled from the cab of the pickup truck or other vehicle on which the plow assembly 10 is mounted. Wings 22, 24 are independantly slidably movable between retracted positions as shown in FIGS. 1–5, fully extended positions as shown in FIGS. 16–18, and forwardly angled positions in which the plow assembly has a generally U-shaped configuration shown in FIGS. 21–24. Plow assembly 10 is primarily adapted for plowing snow when attached to the front of a transport vehicle such as a pickup truck, utility vehicle, tractor, or the like via support frame 14. However, other materials such as gravel, bark mulch, and the like can also be moved with the plow. In addition, plow 12 can be mounted in other ways besides support frame 14, such as by vertical supports secured to the rear of the plow as explained more fully below.

Figure 1:
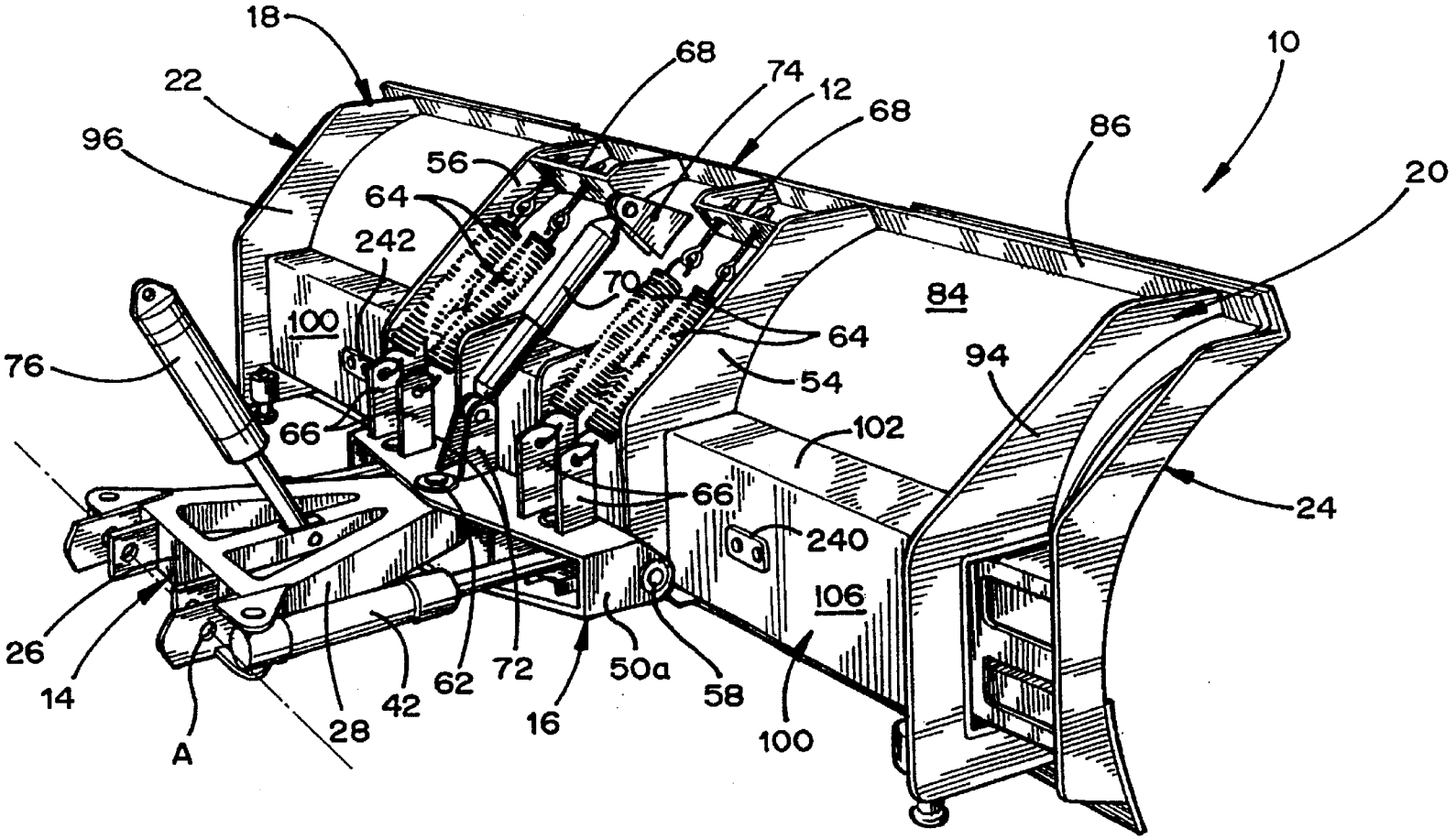
FIG. 1 is a rear perspective view of the adjustable wing plow assembly of the present invention wherein the plow wings are retracted and the plow is centered on a support frame.
Figures 2, 3:
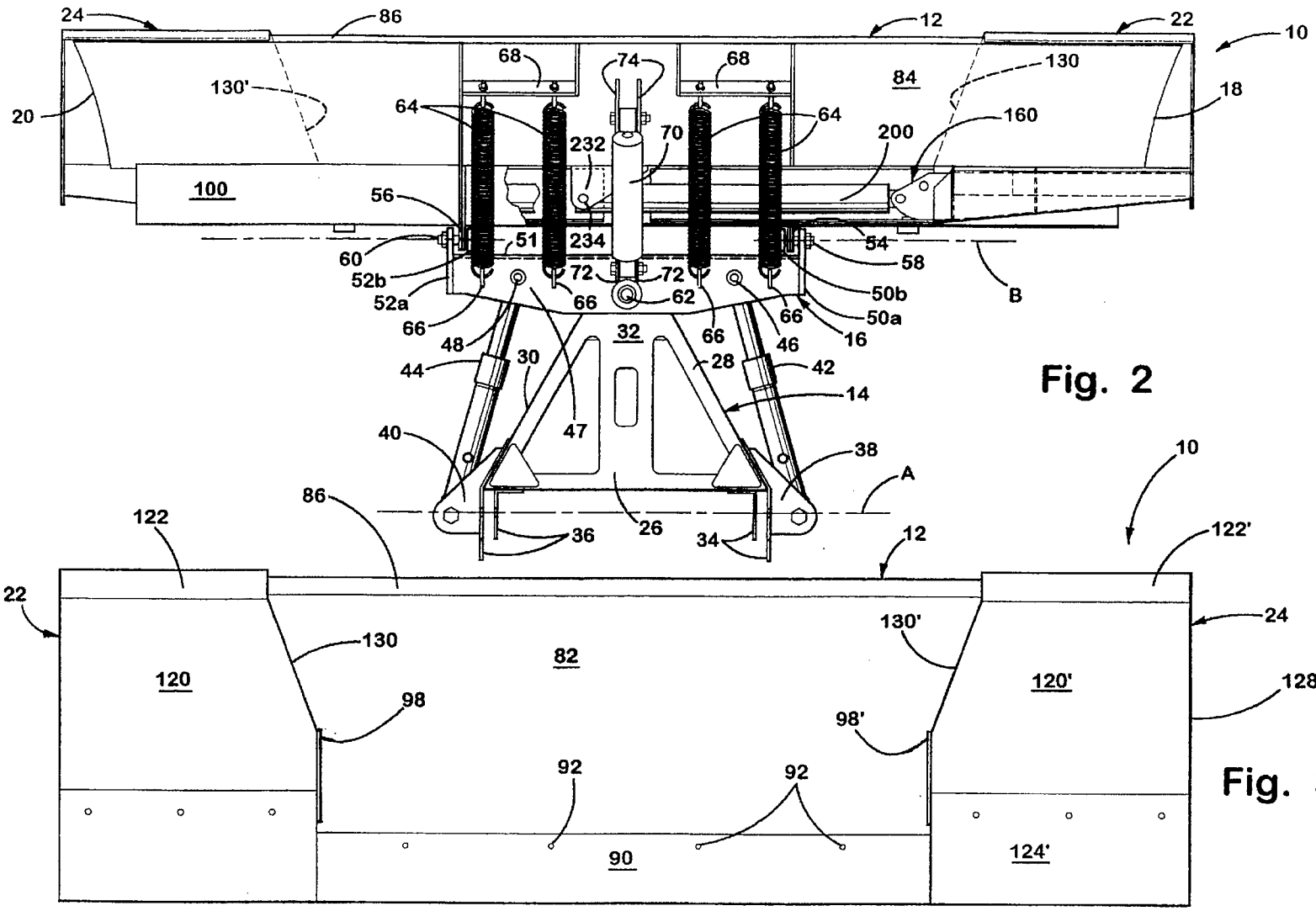
FIG. 2 is a top plan view, with portions broken away, of the plow assembly with wings retracted as shown in FIG. 1.
FIG. 3 is a front elevation of the plow assembly of FIGS. 1 and 2.
Figure 4:
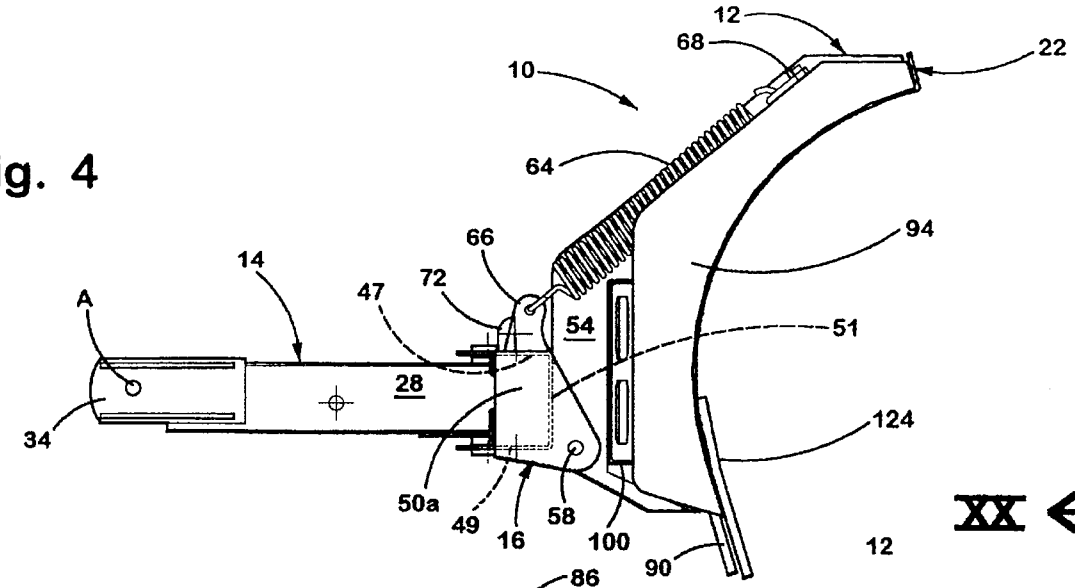
FIG. 4 is an end elevation of the plow assembly of FIGS. 1–3.

As is best seen in FIGS. 1, 2 and 4, support frame 14 is preferably a triangularly shaped, reinforced framework having a base 26, inwardly tapering sides 28, 30 leading to a forward apex 32, and spaced pairs of rearwardly extending support flanges 34, 36 on base 26 adapted to allow frame 14 to be secured to a suitable hitch assembly on the front of a pickup truck or other vehicle for pivotal movement about a horizontal axis A extending through the support flanges. Laterally extending pairs of vertically spaced cylinder support flanges 38, 40 extend outwardly from the opposite sides 28, 30 of frame 14 and the outermost support flanges 34, 36. A pair of extendable, single acting, hydraulic fluid cylinders 42, 44 are pivotally mounted, one on either side of frame 14, between cylinder support flanges 38, 40 and pivot pins 46, 48 on intermediate support 16. Pins 46, 48 extend between spaced upper and lower plates 47, 49 of support 16.

Intermediate support 16 is an elongated steel beam having a generally U-shaped configuration in cross section (FIG. 4), upper and lower plates 47, 49, forward plate 51, and pairs of plow mounting flanges 50*a*, 50*b* and 52*a*, 52*b* welded to the ends of plates 47, 49, 51 and to plate 51 itself and projecting forwardly toward the rear surface of plow 12. Plow 12 includes rearwardly extending, vertically oriented supports or mounting flanges 54, 56 extending between flanges 50*a*, 50*b* and 52*a*, 52*b*, respectively, for mounting on horizontal rods 58, 60 aligned on a common horizontal axis B (FIG. 2) to allow the entire plow 12 to pivot about that horizontal axis. Intermediate support 16 is, in turn, pivotally mounted to apex 32 of support frame 14 by a generally vertically extending pivot pin 62. By controlling the extension and retraction of fluid cylinders 42, 44, intermediate support 16 and plow 12, which is mounted thereon, may be moved to a series of angled positions such that plow 12 is swung and angled to the left or right about pivot 62 as shown in FIG. 16. Plow 12 is biased to an upright position about horizontal axis B on pins 58, 60 by a series of biasing members such as coil springs 64 which extend between mounting flanges 66 extending upwardly from the top surface of intermediate support 16 and support flanges 68 at the top of rear surface 84 of plow 12. In addition, a shock absorber 70 is pivotally mounted between upstanding support flanges 72 on intermediate support 16 and rearwardly extending support flanges 74 on the rear surface 84 of plow 12. Shock absorber 70 dampens the pivotal movement of plow assembly 10 about horizontal axis B on pins 58, 60 during plowing when the plow encounters an obstacle along the surface being plowed thereby causing the plow 12 with wings 22, 24 to tip or pivot forwardly against the bias of springs 64. Rearward pivoting of the plow about axis B on pins 58, 60 is limited by the rear, vertical edges of flanges 54, 56 which engage the forward plate 51 on intermediate support 16 (FIG. 4). Forward pivotal movement is limited by springs 64 and shock absorber 70. When support frame 14 is pivotally secured to a horizontal axis A on a vehicle via support flanges 34, 36, the entire support frame 14, intermediate support 16 and plow 12 including extendable wings 22, 24 may be lifted away from the ground or other support surface via a retractable hydraulic cylinder 76 as shown in FIG. 1. Cylinder 76 is preferably pivotally mounted between the support frame 14 and a mounting point on the pickup truck or other vehicle spaced above the horizontal axis on which support frame 14 is secured.

As will be best seen in FIGS. 1–3, 5, 19 and 20, main plow 12 is preferably an elongated, rectilinear steel moldboard 80 having a concave front surface 82, a convex rear surface 84 and an integral reinforcing flange 86 extending along its upper edge. Secured to a lower flange which extends along the lower edge of moldboard 80 is a reinforcing plate 88 with a replaceable elongated, rectilinear plow blade 90 secured thereto by fasteners 92 having countersunk heads which are flush with the front surface of blade 90 to prevent interference with the material being plowed. Alternately, carriage bolts having rounded heads could be used as fasteners 92. The upper portions of the right and left ends of moldboard 80 are curved to extend outwardly on a large radius curve (FIG. 5) so as to cover the gap between the inner edge of wing extensions 22, 24 and the outer edges of moldboard 80 when plow extensions 22, 24 are extended outwardly as shown, for example, in FIGS. 16–18. The rear surface 84 of moldboard 80 is reinforced with vertically extending supports or mounting flanges 54, 56 on either side of its center, as well as end flanges 94, 96 welded to rear surface 84 adjacent either end.

Figure 19:
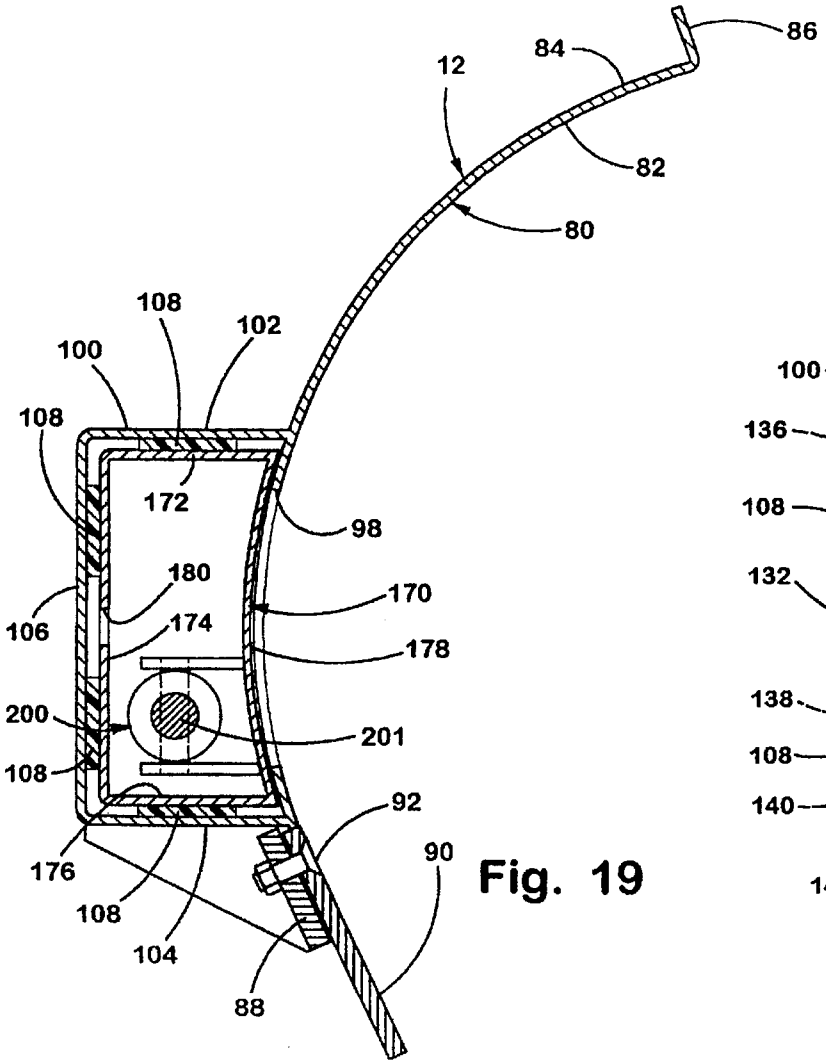
FIG. 19 is a sectional end elevation of the slide assembly for mounting one of the extendable plow wings taken along plane XIX—XIX of FIG. 18.
Figure 21:
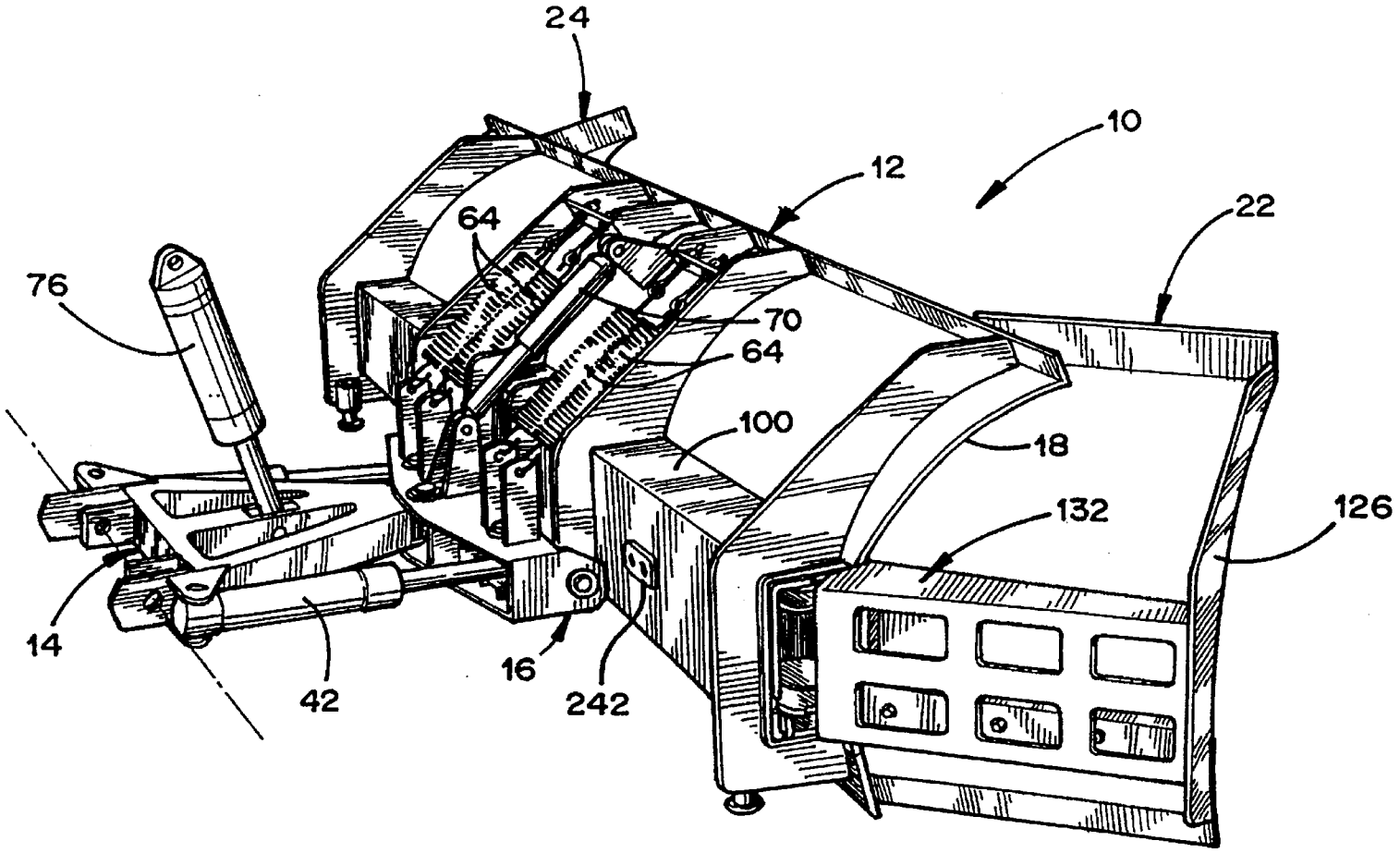
FIG. 21 is a rear perspective view of the plow assembly of the present invention with the plow wings extended and angled forwardly forming a generally U-shaped plow.

Extending parallel to the top and bottom edges of moldboard 80 at either end are elongated, rectangular slots 98, 98' best seen in FIGS. 3, 17 and 19. On the rear surface 84 of moldboard 80 is welded a rectangular, steel slide support or housing 100 having a top wall 102, bottom wall 104, and rear wall 106 forming a generally U-shaped enclosure which is larger than slots or openings 98, 98' on the front of the moldboard. As will be explained below, slide support or housing 100 is adapted to receive a generally rectangular inner slide member 170, 170' best seen in FIGS. 10–13 and 16–18. Synthetic, elongated wear pad strips 108 are secured to the inner surfaces of housing walls 102, 104 and 106 to slidably support the slide members inside housing 100 and to maintain the slide members in contact with the rear surface of 84 of moldboard 80 adjacent slots 98, 98'. Preferably, wear pads 108 are formed from ultra high molecular weight (UHMW) plastic, although other materials such as teflon, steel and/or other materials could also be used. Mounting flanges 54, 56 and reinforcing flanges 94, 96 extend over top wall 102, along rear wall 106 and thereafter along bottom wall 104 of housing 100 and are welded thereto to reinforce the entire assembly. When slide members 170, 170' are received within housing 100 (FIG. 19), their front walls 178, 178' having a radius of curvature parallel to that of moldboard 80, close slots 98, 98' on either end of main plow 12 such that snow or other material being plowed moving upwardly along moldboard 80 from plow blade 90 continues along front surface 82 of the moldboard without interruption and without packing into the interior of housing 100.

As is best seen in FIGS. 3, 5–9 and 20, each plow wing extension 22, 24 is a substantial mirror image of the other, only one being described in detail herein, namely, plow wing 22. Substantially the same elements are included in plow wing extension 24 but are shown with prime numerals.

Figure 20:
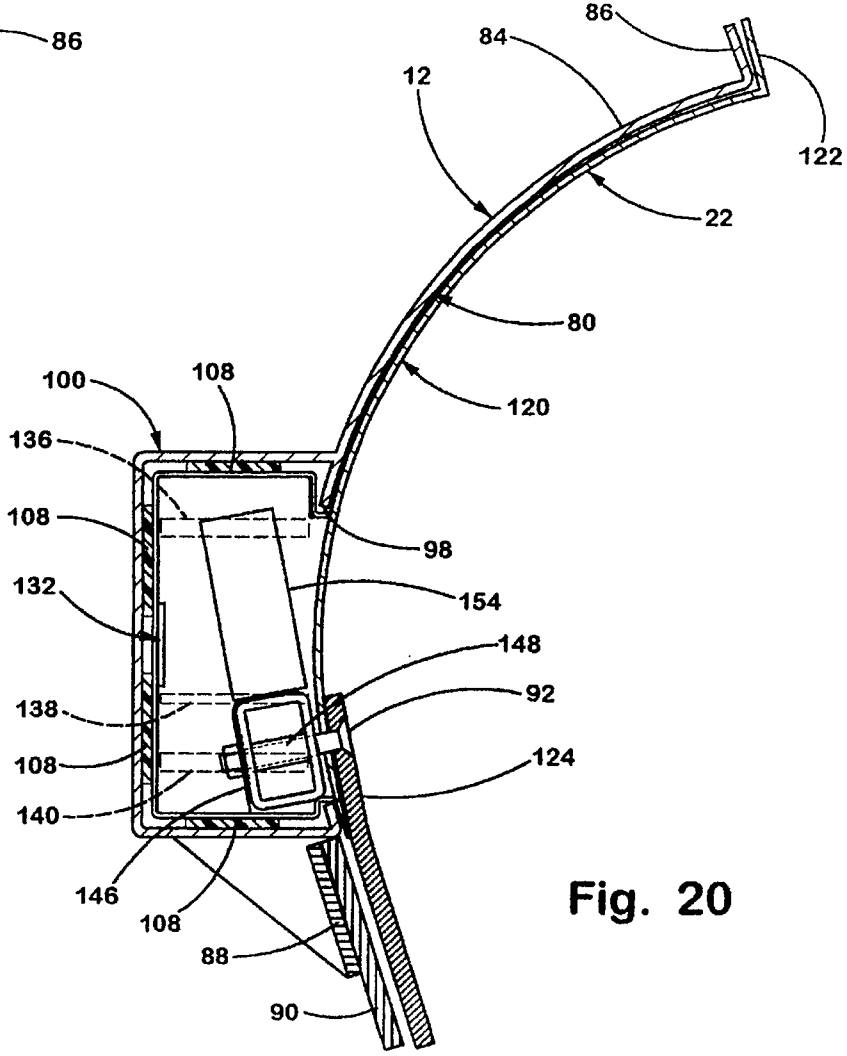
FIG. 20 is a sectional end elevation of one of the extendable plow wings on its slide assembly taken along plane XX—XX of FIG. 5.

Plow wing extension 22 includes a moldboard section 120 having a radius of curvature substantially the same as that for moldboard 80 and extending parallel to moldboard 80 when mounted on the plow assembly. Wing extension 22 includes an integral, upper flange 122 extending along the front surface of range 86 at the top of moldboard 80 and extends over slot or opening 98 on the front surface 82 at the end of moldboard 80. A steel extension blade 124, also known as a cutting edge or wear edge, is secured to the front surface of the lower edge of moldboard 120 and extends generally parallel to plow blade 90, as shown in FIG. 20. Blade 124 engages the plowed surface during plowing and may be repaired or replaced when worn. A generally vertical reinforcing flange 126 extends along the outermost edge 128 of wing extension moldboard 120. The innermost edge 130 of moldboard 120 is inclined downwardly and outwardly from the position of upper flange 122.

Figure 7:
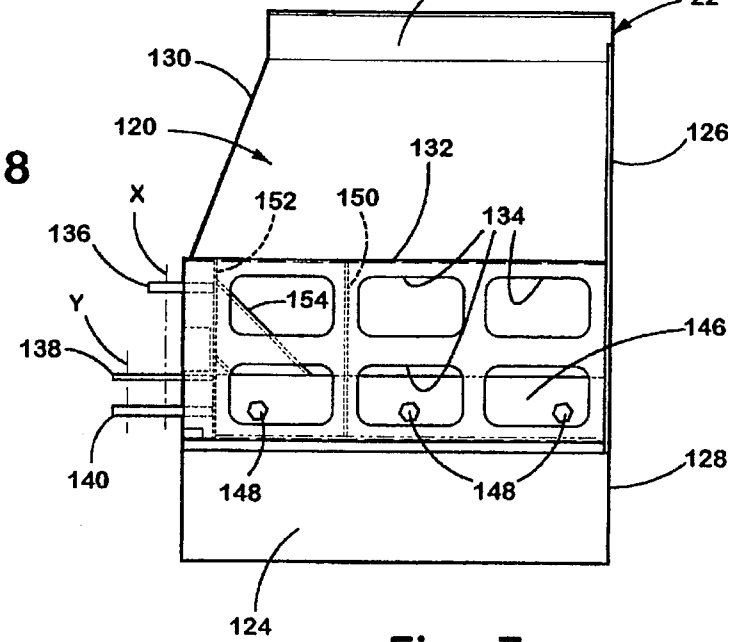
FIG. 7 is a rear elevation of the extendable plow wing of FIG. 6.
Figure 8:
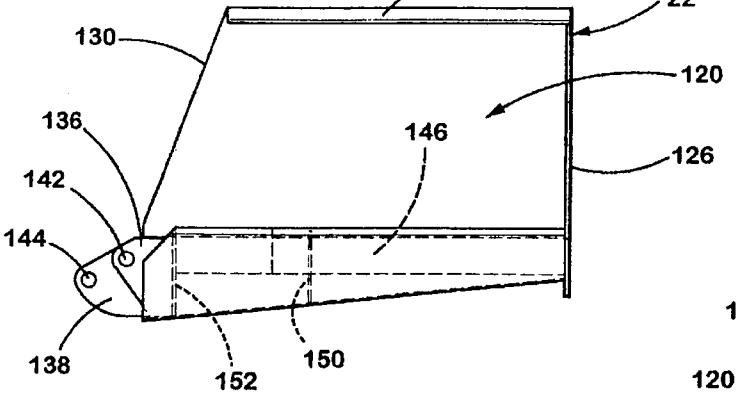
FIG. 8 is a top plan view of the extendable plow wing of FIGS. 6 and 7.
Figure 9:
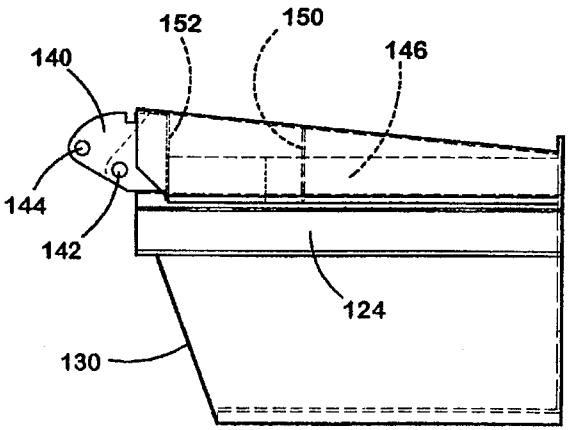
FIG. 9 is a bottom plan view of the extendable plow wing of FIGS. 6–8.
Figure 6:
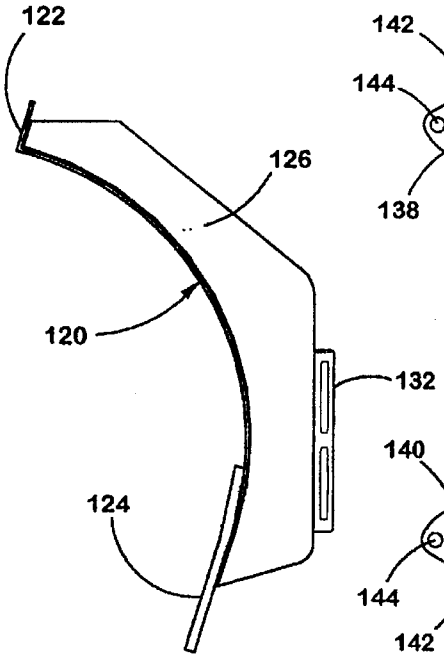
FIG. 6 is an end elevation of one of the extendable plow wings.

Extending parallel to the upper and lower edges of wing extension 22 on the rear surface thereof is a tapered, perforated housing 132 having a series of weight reducing, generally rectangular openings 134 formed therethrough, best seen in FIG. 7. Housing 132 is preferably formed from sheet steel bent into a generally U shaped configuration and welded to the rear surface of moldboard 120. Housing 132 is slightly smaller than both outer housing 100 and inner slide member 170, as will be understood from FIG. 10. At the inner edge of wing extension 22, within housing 132 are a series of three spaced, generally horizontal hinge plates 136, 138, 140 which are best seen in FIGS. 7–9. These hinge plates are welded between the rear surface of moldboard 120 and the interior of housing 132 and project inwardly a predetermined distance. Hinge plate 136 is shorter than plates 138, 140. As will be seen in FIGS. 7–9, a vertical hinge pivot axis X is provided by aligned apertures 142 extending through the three hinge plates, while a fluid cylinder pivot axis Y is provided by apertures 144 extending through longer hinge plates 138, 140. Hinge pivot axis X is offset from fluid cylinder pivot Y by a predetermined distance, as shown in FIGS. 7–9 and 11, to provide a moment arm providing torque for pivoting the wing extension on its hinge axis, as will be explained more fully below. Also mounted within housing 132 is a hollow, rectangular cross section beam 146 which extends along the lower rear surface of moldboard 120 in opposition to the upper edge of extension blade 124. Countersunk, threaded fasteners 148 are passed through the front surface of extension blade 124 and beam 146 to both reinforce the lower edge of the extension moldboard and secure the wing extension blade 124 to the front surface of the moldboard. A pair of generally vertical reinforcing plates 150, 152 are welded within housing 132 at spaced positions, reinforcing plate 152 being adjacent the inner edges of horizontal hinge plates 136, 138, 140, as is best seen in FIG. 7. A diagonal reinforcement or gusset 154 extends between plate 152 and the top surface of beam 146 in each wing extension for additional strength. As will be understood from FIG. 5, plow wing extension 24 is a substantial mirror image of wing extension 22 except that uppermost hinge plate 136' is longer than hinge plate 136. Intermediate hinge plate 138' is spaced more closely to upper plate 136' to allow fastening of the extension rod 203 from a fluid power cylinder 202 which is offset from the position of the fluid power cylinder 200 engaging hinge plates 138, 140 on wing extension 22. In addition, diagonal reinforcing gusset 154' transfers stress from the upper fluid power cylinder 202 to the reinforcing beam 146' in wing extension 24.

With reference to FIGS. 10–15 and 19, each plow wing extension 22, 24 is pivotally mounted to the end of a generally rectangular slide member 170, 170', only one of which is described in detail herein. The subassemblies 160, 160' of slide member 170 and wing extension 22, or slide member 170' and wing extension 24 (FIGS. 10–13 and 18), are both adapted to be slidably mounted telescopingly within housing 100 on the rear surface of main plow moldboard 80 to allow extension, retraction and forward angling of the plow wing extensions 22, 24 by fluid power cylinders 200, 202 as referenced above and as explained more fully below.

Each slide member 170, 170' is an elongated beam having a generally rectangular cross section, formed from welded steel, and including a top wall 172, rear wall 174, bottom wall 176, and concave front wall 178. The cross-sectional shape generally corresponds to the cross-sectional shape of housing 100. The radius of curvature of front wall 178 is substantially the same as for moldboard 80 such that front wall 178 closes slot 98 or 98' when the plow wing extensions are in their extended positions or angled forwardly. Rear walls 174, 174' include elongated, closed slots 180, 180', each adapted to receive a projecting, cylindrical stop 240, 242 which limit the extension and retraction of the slide members, and thus, wing extensions 22, 24, as explained below. The right-hand most fluid power cylinder 200 extends through the interior space within slide member 170, as shown in FIGS. 5, 10, 11, 13 and 19. Fluid cylinder 202 extends through the interior space in slide member 170'.

Figure 10:
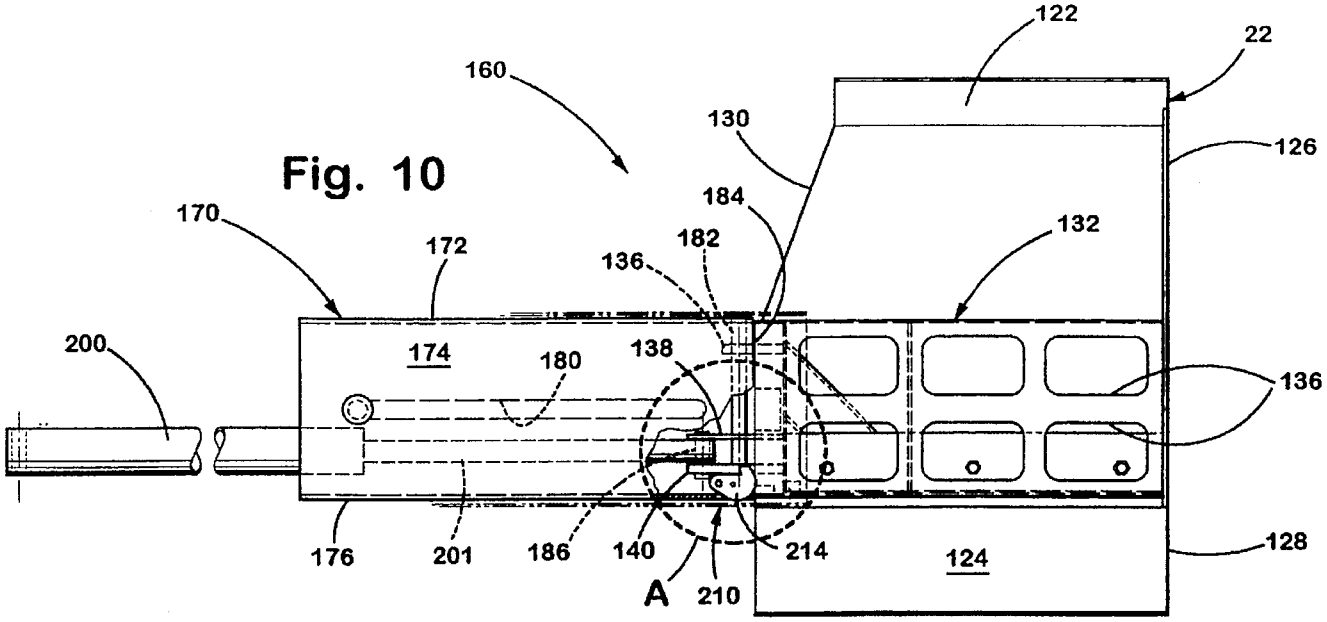
FIG. 10 is rear elevation of the subassembly of a slide, plow wing pivotally mounted thereon, latch assembly and fluid cylinder.
Figure 11:
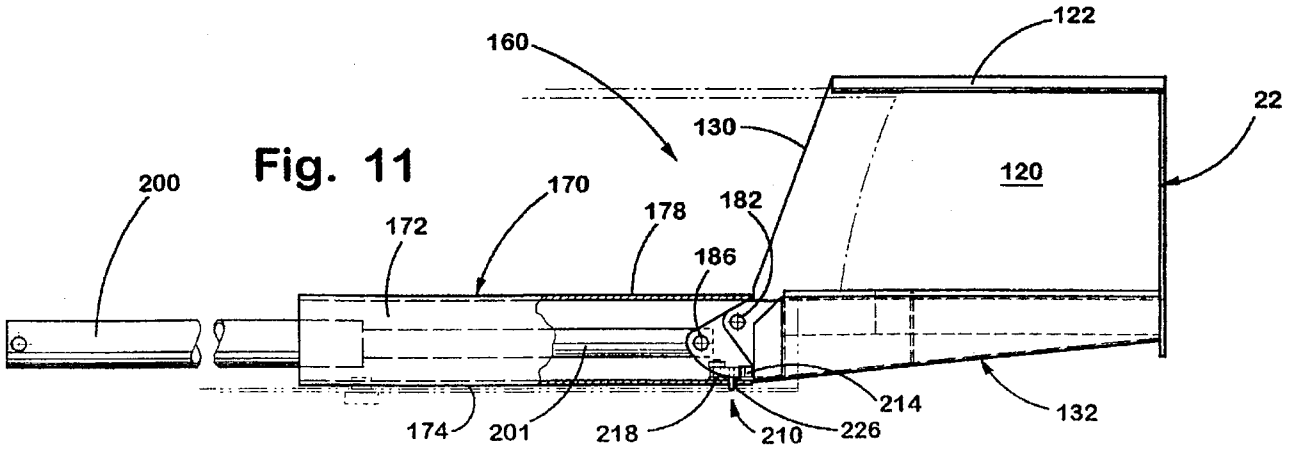
FIG. 11 is a top plan view of the subassembly of FIG. 10.
Figure 13:
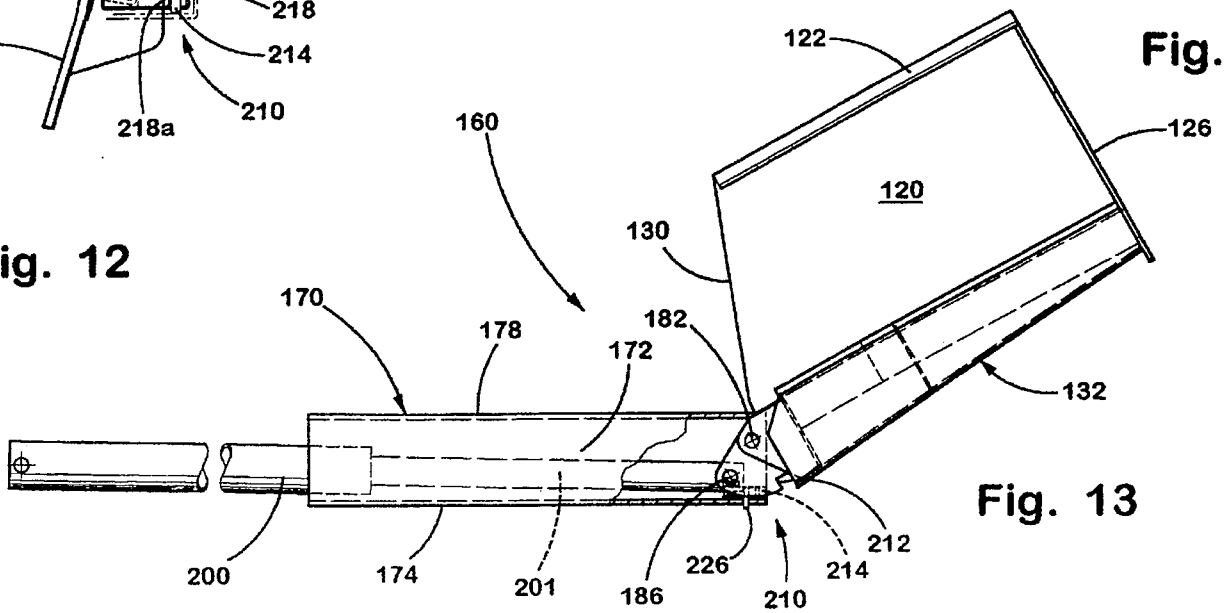
FIG. 13 is a top plan view of the subassembly of FIGS. 10–12 illustrating the plow wing angled forwardly.
Figure 12:
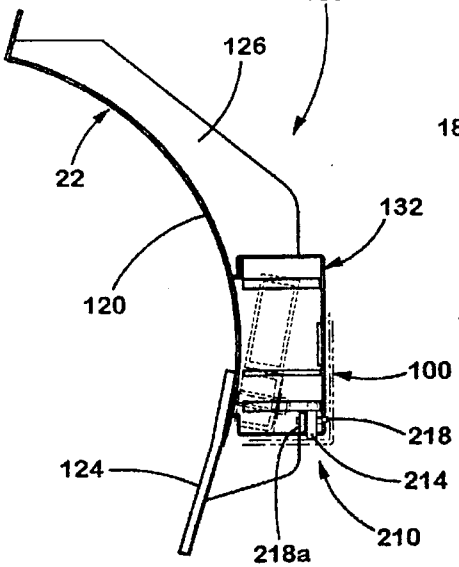
FIG. 12 is an end elevation of the subassembly of FIGS. 10 and 11.

Plow wing extensions 22, 24 are pivotally mounted to the outer ends of elongated slide members 170, 170', respectively, by hinge plates 136, 138, 140. As shown in FIGS. 10 and 11, a hinge pin 182 is welded between top and bottom walls 172, 176 of slide member 170 to extend generally vertically and parallel to the outer end 184 of slide member 170. Hinge pin 182 extends vertically through aligned apertures 142 in the hinge plates such that wing extension 22 pivots on axis X from a position in which moldboard 120 is generally rectilinearly aligned with concave front wall 178 of slide member 170 (FIGS. 10 and 11) to a forwardly angled position in which moldboard 120 extends at an obtuse angle to the front wall 178 of slide member 170 (FIG. 13). Similarly, a shorter hinge pin 186 extends vertically through hinge plates 138, 140 and apertures 144 on axis Y to pivotally secure the outer end of extendable rod 201 from fluid cylinder 200. Because of the offset between the pivot axes X and Y provided by hinge pins 182, 186, when fluid cylinder rod 201 is extended from cylinder 200, the moment arm of the offset created by longer hinge plates 138, 140 rotates wing extension 22 forwardly about hinge pin 182 when slide member 170 reaches its full extension and can no longer be pushed outwardly by the extension of fluid cylinder rod 201. Likewise, wing extension 24 is rotated by rod 203 from cylinder 202 when slide member 170' reaches its fully extended position.

Figure 15:
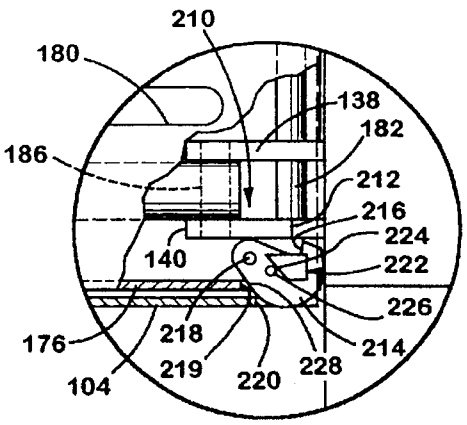
FIG. 15 is an enlarged, fragmentary view similar to FIG. 14 but showing the latch disengaged from the plow wing hinge.
Figure 14:
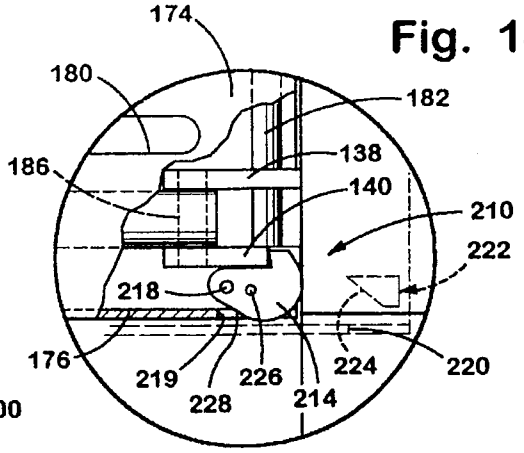
FIG. 14 is an enlarged, fragmentary view of area A in FIG. 10 illustrating the latch assembly for one of the extendable plow wings, the latch assembly being engaged.

As shown in FIGS. 5, 12–15 and 18, the pivoting of wing extensions 22, 24 from their extended, rectilinear positions to their forwardly angled positions is prevented until slide members 170, 170' are fully extended by means of latch assemblies 210, 210'. In latch assembly 210 the lower most hinge plate 140 includes a rectangular notch or recess 212 on its rear most edge (FIGS. 13 and 15). A latch member 214 including an upwardly extending keeper 216 is pivotally mounted on pin 218 between the inside of rear wall 174 of slide member 170 and an upstanding support 218*a* on the inside of bottom wall 176 (FIG. 12) for pivotal movement in a generally vertical plane. An opening 219 extends through bottom wall 176 of slide 170 while an opening 220 extends through the bottom wall 104 of outer housing 100 at the outer end of housing 100 adjacent outer end 18 of the main plow moldboard. A similar pivotal latch member 214' is mounted in slide member 170' and similar openings extend through slide member 170' and outer housing 100 adjacent outer end 20 of plow 12. Hence, as slide members 170, 170' are slidably extended and retracted, keepers 214, 214' travel with the slide members. When pivoted upwardly as shown in FIG. 14, keeper 216 on latch member 214 engages notch 212 to prevent rotation of the hinge plates about pin 182 and, thus, prevent forward angling movement of the wing extension to the position shown in FIG. 13 unless the slide member is fully extended. In its fully extended position, the latch member 214 and opening 219 are aligned with opening 220 in the outer housing bottom wall allowing latch member 214 to pivot downwardly moving keeper 216 out of engagement with notch 212 and allowing pivotal movement of the hinge plates. Such downward pivotal movement of the latch member normally occurs due to gravity when slide member 170 reaches its outermost position. However, because plow assembly 10 is designed for use in extreme weather conditions, which, over time, could cause corrosion or other restriction in pivotal movement of latch member 214 about pin 218, a wedge member 222 is welded to the inside surface of rear wall 106 of outer housing 100. Wedge member 222 has an inclined face 224 (FIGS. 14 and 15). A pin or projection 226 extends rearwardly from latch member 214 through a recess or opening in rear wall 174 and is engaged by the inclined surface 224 of wedge member 222 to force the latch member 214 to pivot downwardly as the slide member reaches its outermost position. Simultaneously, latch member 214 and opening 219 come into alignment with opening 220 in bottom wall 104 allowing the latch member to pivot downwardly in the intended manner. Likewise, when slide member 170 is withdrawn or retracted by movement to the left as shown in FIGS. 10–15, pin 226 is moved out of engagement with wedge member 222 while the edge of opening 220 engages the downwardly inclined edge 228 of latch member 214 to cause upward pivotal movement of the latch member. This causes keeper 216 to re engage with notch 212 to lock wing extension 22 in its aligned position with the front wall 178 of slide member 170 and moldboard 120 in alignment with the main plow moldboard 80. Latch assembly 210' operates in the same manner as latch assembly 210 to prevent pivoting of wing extension 24 until slide 170' is fully extended.

Figure 5:
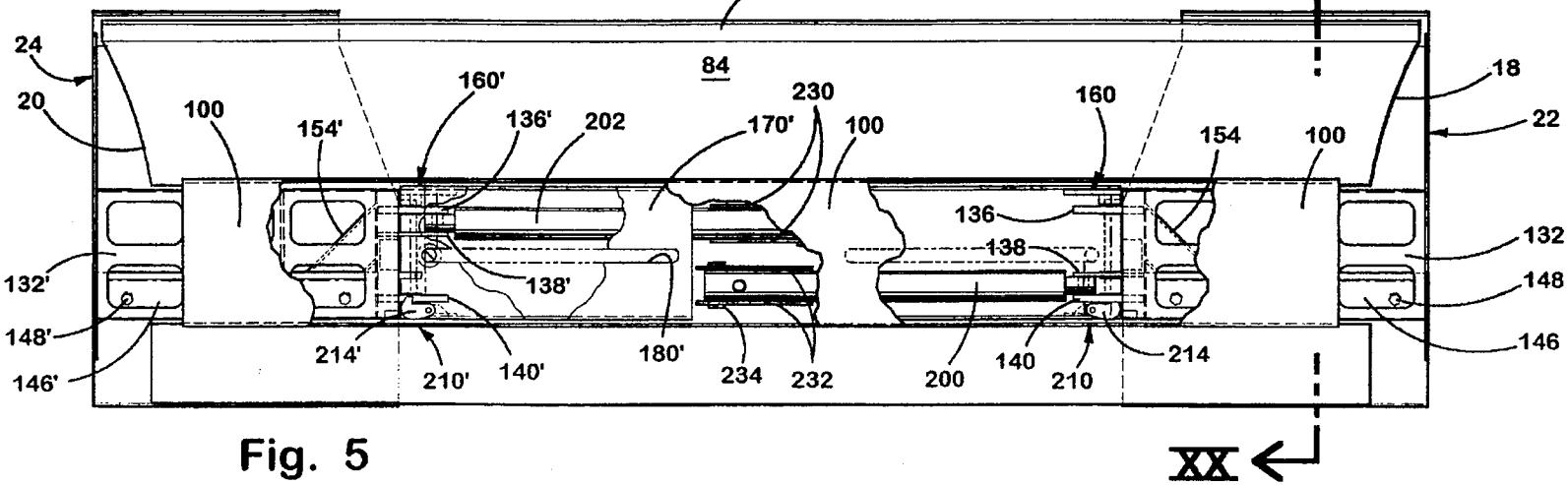
FIG. 5 is a rear elevation of the plow assembly of FIGS. 1–4 with portions broken away to illustrate the fluid cylinders, hinge and slide assembly for each of the extendable plow wings.

With reference to FIGS. 2 and 5, it will now be understood that the subassemblies 160, 160' of slide members 170, 170' and their pivotally attached plow wing extensions 22, 24, respectively, are telescopingly mounted within the interior of outer housing 100 on wear pads 108 for sliding rectilinear movement within the outer housing along a common axis. Movement of each slide member 170, 170' is accomplished by a power source, preferably a pair of independent, overlapping, double acting, hydraulic fluid cylinders 200, 202 as noted above. Two pairs of vertically aligned and spaced fluid cylinder support plates 230, 232 are welded to extend rearwardly from the rear surface 84 of main plow moldboard 80 (FIGS. 2 and 5). The nonextendable end of fluid cylinder 200 is pivotally mounted between the lower pair of support plates 232 on pivot pin 234. The nonextendable inner end of fluid cylinder 202 is pivotally supported between plates 230 on pivot pin 236 (FIG. 18). Extendable rods 201, 203 from each fluid cylinder 200, 202 are pivotally mounted between hinge plates 138, 140 and 136', 138', respectively. Although two, double acting, hydraulic fluid cylinders are preferably shown for use in the preferred embodiment of the invention, it is within the scope of the invention to utilize other power sources such as a single, double acting, hydraulic fluid cylinder having extendable rods projecting from either end. Alternately, threaded rods rotated by at least one electric motor or a pulley and cable system could be used to move slides 170, 170' outwardly or inwardly for extension and retraction.

Sliding movement of slide member 170, 170' is limited by projecting, cylindrical stop members 240, 242 which are mounted in the rear wall 106 of outer housing 100 (FIGS. 1 and 18) in alignment with slots 180, 180' in the slide members. As fluid cylinders 200, 202 are operated to extend rods 201,203, slide member 170, 170' are moved rectilinearly outwardly on wear pads 108 until stops 240, 242 engage the inner ends of slots 180, 180' stopping further outward extension of the plow wings. In the extended positions, as shown in FIGS. 16–18, the outer wing ends 128, 128' are spaced outwardly of the outer ends 18, 20 of main plow moldboard 80. Since the upper ends of the main plow moldboard 80 taper outwardly, the gap between the edges 130, 130' of the wing extensions and the outer edges of the main plow moldboard are substantially closed when the wings are fully extended as shown in FIGS. 16–18.

Figure 22:
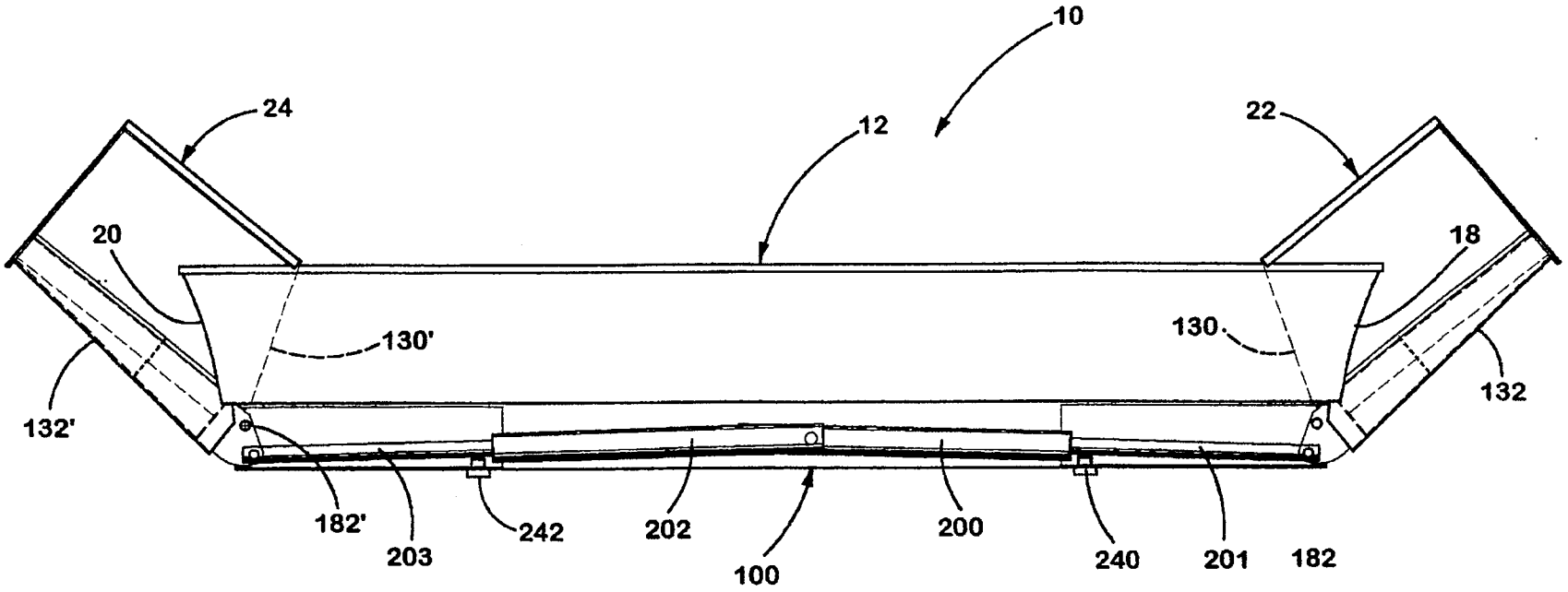
FIG. 22 is a top plan view of the plow assembly in the configuration of FIG. 21 with portions broken away.
Figure 23:
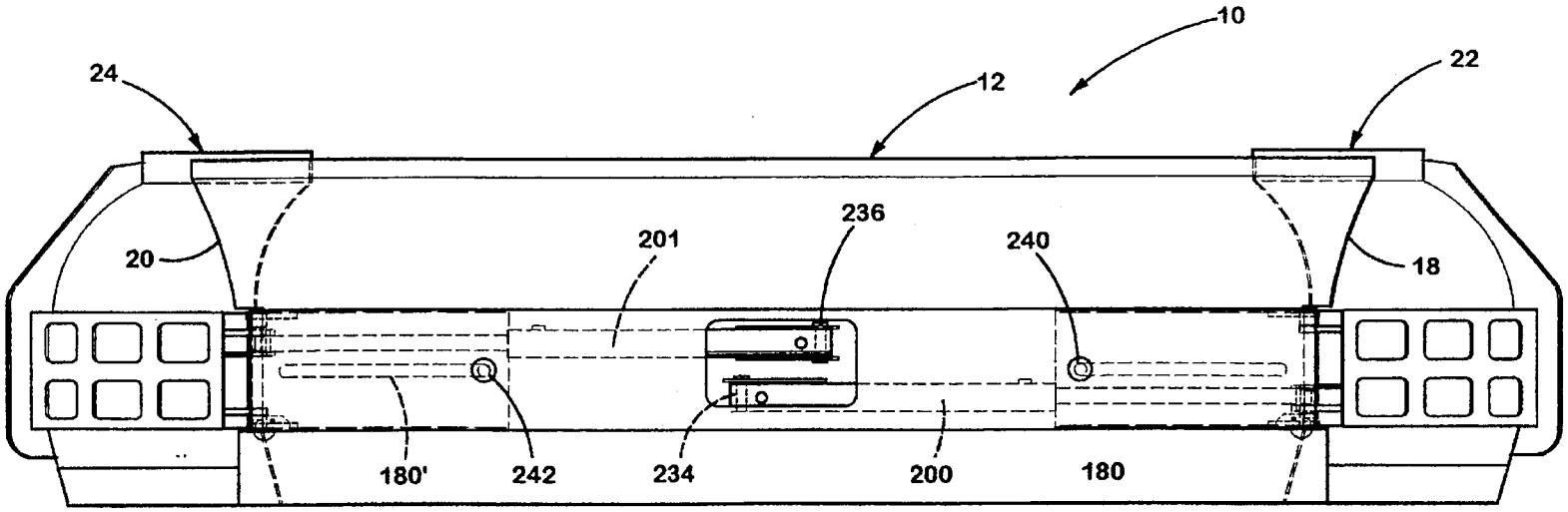
FIG. 23 is a rear elevation of the plow assembly in the configuration of FIGS. 21 and 22.
Figure 24:
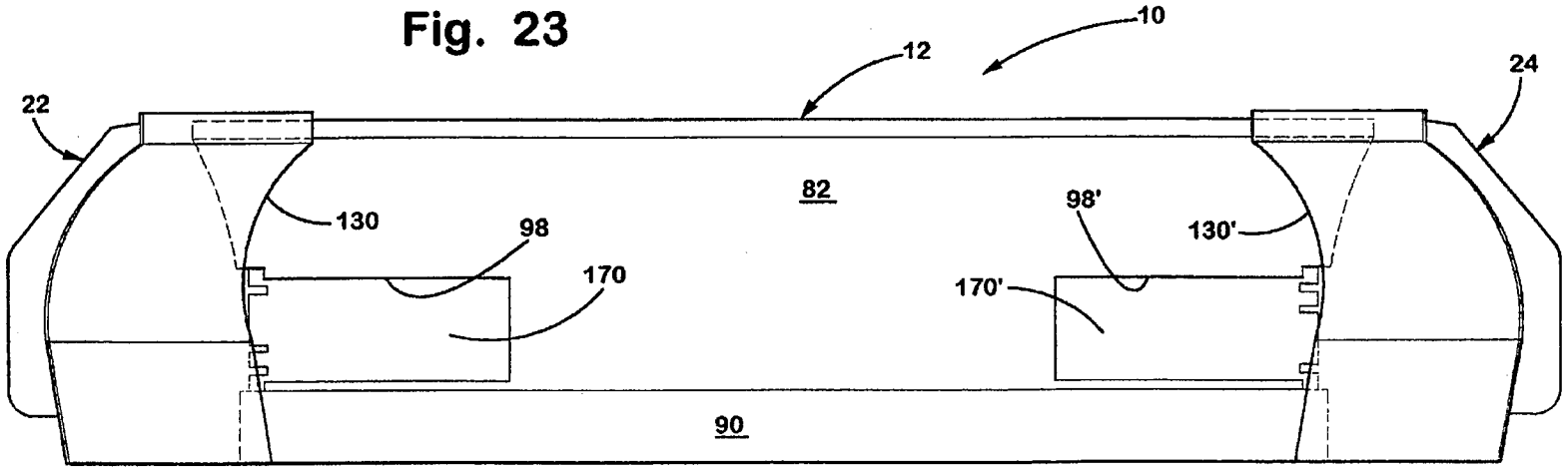
FIG. 24 is a front elevation of the plow assembly in the configuration of FIGS. 21–23.

At the point of full extension, latch members 214, 214' are aligned with openings 220, 220' in the bottom wall 104 of outer housing 100 as shown in FIGS. 14, 15 and 18. In addition, wedge member 222 on the inner surface of outer housing rear wall 106 engages pin 226 to force latch member 214 to pivot downwardly releasing keeper 216 from notch 212 in hinge plate 140. The same occurs with latch assembly 210' such that wing extension 24 is released. Thus, at the fully extended position, plow wing extensions 22, 24 are unlocked, released and freed to pivot forwardly from their extended positions in which the moldboards 120, 120' are substantially parallel to the front surface 82 of moldboard 80 and in rectilinear alignment therewith. Further extension of pivotally mounted fluid cylinders 200, 202 causes rotation of wing extensions 22, 24 forwardly about hinge pins 182, 182' due to the distance between pivot axes X and Y as shown in FIG. 7 and because further outward extension of slide member 170, 170' is prevented by stop members 240, 242 engaging the ends of slots 180, 180'. Such cylinder extension causes rotation of the plow wings to the positions shown in FIGS. 21–24 such that both wing extensions are pivoted forwardly at an obtuse angle to the main plow moldboard and thereby forming a generally U shaped configuration for the plow assembly. In such position, as shown in FIGS. 22–24, ends 18, 20 of main plow moldboard 80 substantially overlap the inner edges 130, 130' of the wing extensions. The outward taper of edges 130, 130' allows the extensions to be pivoted to the forward position without interference between those edges and the main plow moldboard. Hydraulic pressure within cylinders 200, 202 keeps the wing extensions in the forwardly pivoted positions for pushing or carrying snow such that the snow does not slip off the ends of the plow assembly. At the same time, front walls 178, 178' of slide member 170, 170' cover the openings 98, 98' in the main plow moldboard and prevent snow from being packed into the inside of the outer housing and allow the plow assembly to function normally.

Likewise, when fluid cylinders 200, 202 are retracted, the opposite motions occur. First, wing extensions 22, 24 are pivoted rearwardly into alignment with main plow moldboard 80 about pivot pins 182. When housings 132, 132' are aligned with slide members 170, 170' further retraction of the fluid cylinders causes latch members 214, 214' to pivot upwardly and engage notches 212, 212' as the slide members are retracted. Further retraction of the fluid cylinders causes the plow wings 22, 24 to move along the front surface of the main plow moldboard to the retracted positions shown in FIGS. 1–3 and 5. Inward movement of the slide members 170, 170' is limited by the stop members 240, 242 engaging the outer ends of slots 180, 180' preventing further inward sliding movement of the slide members. In each position, openings 98, 98' allow the hinged wing extension to be mounted on slides 170, 170' adjacent the rear surface 84 of main plow moldboard 80 with the hinges extending through the openings for movement of wing extensions 22, 24 along the front surface of the main plow. Thus, the plow assembly may be used in its retracted position to plow snow when either centered or angled to the left or right, the preferred length of such plow in the retracted position being approximately 8 feet. Secondly, cylinders 200, 202 can be extended simultaneously or independently of one another such that wing extensions 22, 24 are in their fully extended positions as shown in FIGS. 16–18 and the plow may also be used either centered or angled left or right by extending one or the other of fluid cylinders 42, 44. With the wing extensions fully extended, the plow assembly has an overall length of approximately eleven feet. Further, as shown in FIGS. 21–24, yet further extension of cylinder 200, 202 causes forward pivotal movement of plow extensions 22, 24 to the positions shown therein providing a substantial U shape for the plow assembly allowing snow or other material to be pushed or carried from one position along a horizontal surface to another without the snow slipping off the ends of the plow assembly. It is also possible to extend only one or the other of wing extensions 22, 24 such that the plow may be used with only one end extended or pivoted forwardly, or one end extended with the opposite end extended and pivoted forwardly.

Figure 25:
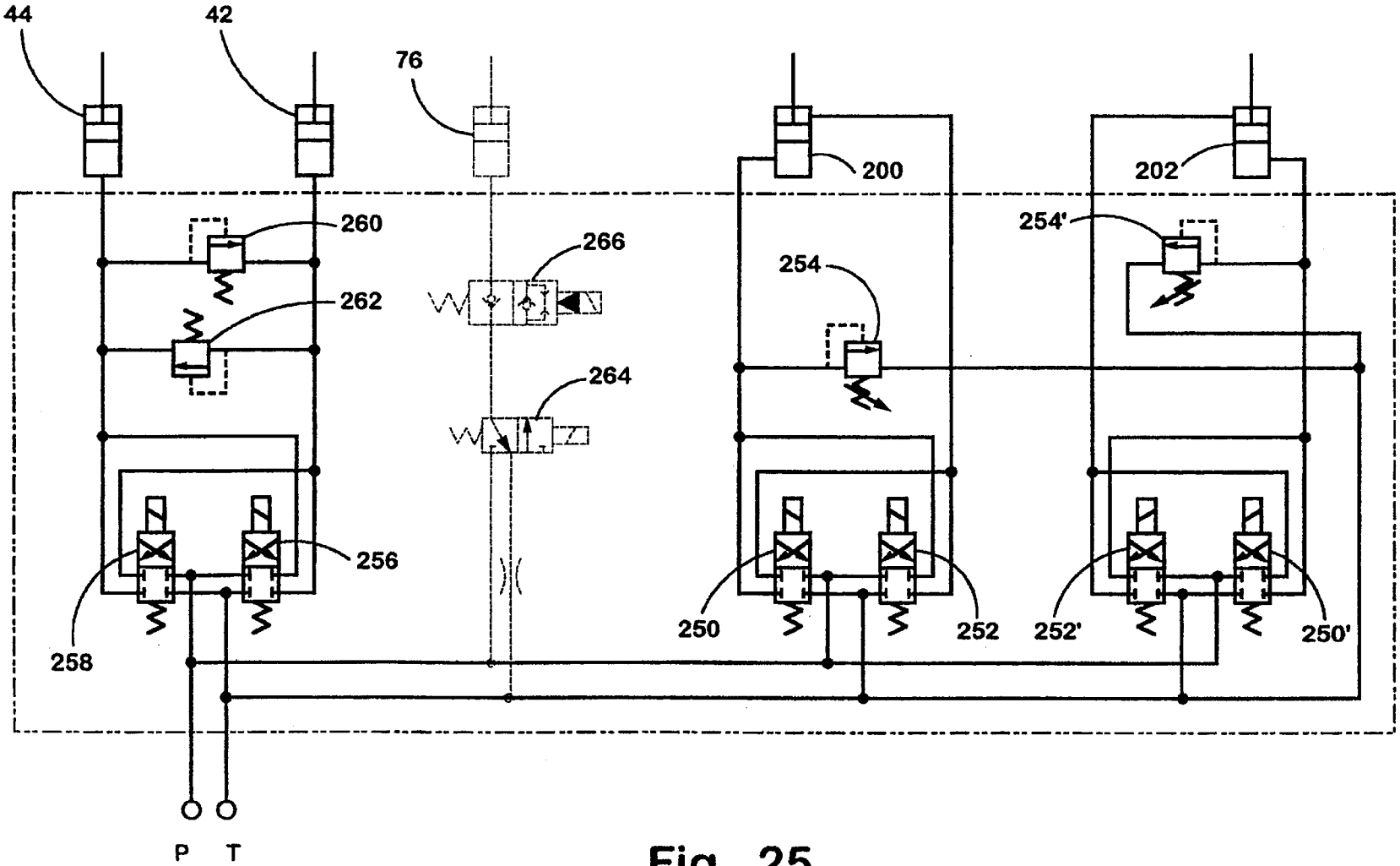
FIG. 25 is a schematic illustration of the hydraulic system for operation of the adjustable plow assembly of the present invention.

As shown in FIG. 25, each hydraulic fluid cylinder 200, 202 is controlled by a pair of solenoid operated valves 250, 252 and 250', 252' which direct hydraulic fluid from the hydraulic system into the fluid cylinder to either extend or retract rods 201,203. Pressure release valves 254, 254' are included within the system to prevent over pressurization of each of cylinders 200, 202. Likewise, angling of the plow assembly to the left or right is accomplished by fluid cylinders 42, 44 which are controlled by solenoid operated fluid valves 256, 258, respectively. Again, pressure release valves 260, 262 are included between the hydraulic lines leading to cylinders 42, 44 to prevent overpressurization. Pressure release valves 254, 254' release pressure exerted on the system should wings 22,24 encounter an obstacle or other sudden rearward load when extended and pivoted. forwardly and allow hydraulic fluid to be directed back to storage to provide system relief when forces generated exceed specified system pressures. Likewise, valves 260,262 release overload pressures exerted on angling cylinders 42,44 in the event an obstacle engages the plow.

In the event a lift cylinder 76 is included on support frame 14, it too may be operated by a solenoid operated fluid valve 264 with a hydraulic lock valve 266 included in the system to hold the lift cylinder 76 in position when raised. All of these fluid cylinders can be easily controlled with the solenoid operated fluid valves 250, 252, 250', 252', 256, 258, 264, and 266 having electrical controls which are positioned on a control panel in the cab of the vehicle for easy access by the driver to allow operation without leaving the vehicle cab. Such remote control greatly increases the speed and efficiency of adjustment of the plow assembly without the need for exiting the cab.

As will also be appreciated, it is also possible to support the plow assembly including main plow 12 and wing extensions 22, 24 on a support other than support frame 14 and intermediate support 16 at the front of a vehicle. For example, should the plow be used on a grader, an overhead beam may include downwardly extending rods or other supports which engage rear mounting flanges 54, 56 from above to support the assembly in the normal horizontal position shown in the drawings. Other supports such as bulldozer type support arms extending from the rear of the plow to a support frame on a vehicle may also be used with this plow assembly.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted according to the principals of patent law, including the Doctrine of Equivalents.

The embodiments of the invention in which an exclusive property or privilege is claimed are defined as follows:

1. A plow assembly for vehicles, said assembly comprising:

a plow having first and second ends, a front material engaging surface, and a rear surface opposite said front surface;

a support for attaching said plow to the vehicle;

an extendable plow wing on said first end of said plow, said wing having inner and outer ends, a front, material engaging surface, and rear surface opposite said front surface, said plow wing being mounted for sliding movement along said front surface of said plow at said first end between a retracted position in which said outer end of said wing is adjacent said first end of said plow and an extended position in which said outer wing end is spaced outwardly of said first end of said plow with said wing front surface generally aligned with said plow front surface;

said plow wing including a hinge, said plow wing being pivotally mounted on said hinge for movement between said extended position and a forwardly angled position in which said wing front surface extends at an angle to said plow front surface; and a power source connected to said plow wing and operable to move said wing between said retracted, extended and forwardly angled positions.

2. The plow assembly of claim 1 including a latch assembly which prevents pivotal movement of said plow wing to said forwardly angled position until said plow wing is in said extended-position.

3. The plow assembly of claim 2 including a slide mounted on said plow; said plow wing, hinge and latch assembly being mounted on and movable with said slide.

4. The plow assembly of claim 3 wherein said slide is telescopically mounted within a housing on said rear surface of said plow; said plow including an opening therethrough through which said hinge extends to support said plow wing for sliding movement along said front surface of said plow.

5. The plow assembly of claim 4 wherein said slide includes an elongated beam having a cross sectional shape generally corresponding to the cross-sectional shape of said housing, said plow assembly including at least one wear pad intermediate the inner surface of said housing and the outer surface of said beam.

6. The plow assembly of claim 5 including a stop on one of said beam and housing and an aperture in the other of said beam and housing, said aperture having opposing ends; said stop engaging one of said aperture ends when said plow wing is in said retracted position, and engaging the other of said aperture ends when said plow wing is in said extended position.

7. The plow assembly of claim 3 wherein said power source is an extendable fluid power cylinder having two ends; one end of said fluid cylinder pivotally connected to said rear surface of said plow, the other end of said fluid cylinder pivotally connected to said hinge.

8. The plow assembly of claim 7 wherein said hinge is pivotally connected to said slide along a generally vertical pivot axis, said other end of said fluid cylinder being pivotally connected to said hinge at a distance from said pivot axis.

9. The plow assembly of claim 1 wherein the vehicle has a longitudinal axis generally aligned with the direction of motion of the vehicle when traveling in forward or reverse; said support including a support frame for attaching said plow to the front of the vehicle; said plow being pivotally mounted on said support frame for movement about a first, generally vertical pivot axis from a centered position extending generally transverse to the longitudinal axis of the vehicle to a series of angled positions in which said plow is angled to the left or right of said centered position.

10. The plow assembly of claim 9 wherein said plow is pivotally connected to said support frame about a second, generally horizontal pivot axis to allow forward pivotal movement of said plow and plow wing in unison when at least one of said plow and plow wing encounter an obstacle during plowing.

11. The plow assembly of claim 10 including an intermediate support extending between said plow and support frame, said intermediate support connected to said support frame about said first pivot axis and connected to said rear surface of said plow on said second pivot axis.

12. The plow assembly of claim 11 including biasing means extending between said plow and said intermediate support for urging said plow into an upright, generally vertically oriented position about said second pivot axis.

13. The plow assembly of claim 11 including a shock absorber extending between said plow and said intermediate section for dampening pivotal movement of said plow and plow wing about said second pivot axis.

14. The plow assembly of claim 11 including at least one extendable fluid power cylinder for pivotally moving said plow, plow wing and intermediate section about said first pivot axis, said fluid power cylinder having two ends, one end pivotally connected to said support frame, the other end pivotally connected to said intermediate support.

15. The plow assembly of claim 11 wherein said support frame includes a pivot mount defining a third pivot axis spaced from said first and second pivot axes, said third pivot axis adapted to provide a generally horizontal axis for connection to the vehicle to allow lifting said plow and plow wing away from the ground when not in use.

16. The plow assembly of claim 2 including a second extendable plow wing on said second end of said plow, said second wing being mounted for sliding movement along said front surface of said plow at said second end between a retracted position in which said outer end of said wing is adjacent said second end of said plow and an extended position in which said outer wing end is spaced outwardly of said second end of said plow with said plow wing front surface generally aligned with said plow front surface; said second plow wing also including a second hinge, said second plow wing being pivotally mounted on said second hinge for movement between said extended position and a forwardly angled position in which said second plow wing front surface extends at an angle to said plow front surface;

a second power source connected to said second plow wing and operable to move said second plow wing between its retracted, extended and forwardly angled positions; and a second latch assembly which prevents pivotal movement of said second plow wing to said forwardly angled position until said second plow wing is in said extended position.

17. The plow assembly of claim 16 wherein said power source and second power source are operable independently of one another such that said plow wing and second plow wing are independently movable between their respective retracted, extended and forwardly angled positions, said plow wings forming a general U shape with said plow when both plow wings are in their forwardly angled positions to facilitate pushing material being plowed without such material slipping off the plow ends.

18. The plow assembly of claim 16 including a second slide mounted on said plow; said second plow wing, second hinge and second latch assembly being mounted on and movable with said second slide.

19. The plow assembly of claim 18 wherein said second slide is telescopically mounted within a second housing on said rear surface of said plow; said plow including a second opening therethrough through which said second hinge extends to support said second plow wing for sliding movement along said front surface of said plow.

20. The plow assembly of claim 19 wherein said second slide includes a second elongated beam having a cross-sectional shape generally corresponding to the cross-sectional shape of said second housing, said plow assembly including at least one wear pad intermediate the inner surface of said second housing and the outer surface of said second beam.

21. The plow assembly of claim 20 including a stop on one of said second beam and second housing and an aperture in the other of said second beam and second housing, said aperture having opposing ends; said stop engaging one of said aperture ends when said second plow wing is in said retracted position, and engaging the other of said aperture ends when said second plow wing is in said extended position.

22. The plow assembly of claim 19 wherein said second power source is an extendable fluid power cylinder having two ends; one end of said fluid cylinder pivotally connected to said rear surface of said plow blade, the other end of said fluid cylinder pivotally connected to said second hinge.

23. The plow assembly of claim 22 wherein said second hinge is pivotally connected to said second slide along a generally vertical pivot axis, said other end of said fluid cylinder being pivotally connected to said second hinge at a distance from said pivot axis.

24. The plow assembly of claim 22 wherein said slide and second slide are aligned with one another along a common axis for extension and retraction; said power source including a fluid cylinder; said fluid cylinder and second fluid cylinder overlapping one another on said rear surface of said plow blade.

25. The plow assembly of claim 18 wherein each of said latch assembly and second latch assembly includes a latch member pivotally mounted on said respective slide and a latch surface on said respective hinge, said latch member engaging said latch surface to retain said respective plow wing aligned with said plow front surface except when said plow wing is in said extended and forwardly angled positions.

26. The plow assembly of claim 1 including a slide support and a slide mounted on said plow in said slide support; said plow wing and hinge being mounted on and movable with said slide; a stop on one of said slide and said support and an aperture on the other of said slide and support, said aperture having opposing ends; said stop engaging one of said aperture ends when said plow wing is in said retracted position, and engaging the other of said aperture ends when said plow wing is in said extended position.

27. The plow assembly of claim 26 wherein said slide support is a housing which surrounds said slide, said slide being telescopingly mounted in said housing.

28. A plow assembly for vehicles, said assembly comprising:

a plow having first and second ends, a front material engaging surface, and a rear surface opposite said front surface;

a support for attaching said plow to the vehicle;

first and second extendable plow wings, each wing having a cross-sectional contour corresponding to said plow, inner and outer ends, a front, material engaging surface, and a rear surface opposite said front surface; said first wing being mounted for sliding movement along said front surface of said plow at a first of said plow ends, said second wing being mounted for sliding movement along said front surface of said plow at the second of said plow ends, each of said wings being movable between a retracted position in which said outer end of said wing is adjacent its respective end of said plow and an extended position in which said outer wing end is spaced outwardly from its respective end of said plow, each of said wings being generally aligned with said plow front surface when in said extended position;

each plow wing also including a hinge and being pivotally mounted on said hinge for movement between said extended position and a forwardly angled position in which said wing front surface extends at an angle to said plow front surface; and a power source operable to move each of said plow wings independently of the other plow wing such that said plow wings are independently movable between said respective retracted, extended, and forwardly angled positions, said plow wings forming a general U shape with said plow when both plow wings are in their forwardly angled positions to facilitate pushing material being plowed without such material slipping off the plow ends.

29. The plow assembly of claim 28 including first and second slides mounted on said plow; said first plow wing and hinge mounted on and movable with said first slide; said second plow wing and hinge mounted on and movable with said second slide.

30. The plow assembly of claim 29 wherein each slide is telescopically mounted within a housing on said rear surface of said plow; said plow including first and second openings therethrough, said hinge for said first plow wing extending through said first opening to support said first plow wing for sliding movement along said front surface of said plow; said hinge for said second plow wing extending through said second opening to support said second plow wing for sliding movement along said front surface of said plow.

31. The plow assembly of claim 30 wherein each of said first and second slides includes an elongated beam having a cross sectional shape generally corresponding to the cross sectional shape of said respective housing in which it is mounted; said plow assembly also including at least one wear pad intermediate the inner surface of each of said respective housings and the outer surface of said beam therein.

32. The plow assembly of claim 31 including a stop on each of said respective housings and an aperture in each of said respective beams, said apertures each having opposing ends, each of said stops engaging one of said aperture ends in its respective aperture when its respective plow wing is in said retracted position, and engaging the other of said aperture ends when its respective plow wing is in said extended position.

33. The plow assembly of claim 30 including a latch assembly on each of said slides which prevents pivotal movement of said plow wing on that slide to said forwardly angled position until said plow wing is in said extended position.

34. The plow assembly of claim 33 wherein each of said latch assemblies includes a latch member pivotally mounted on said respective slide and a latch surface on said respective hinge, said latch member engaging said latch surface to retain said respective plow wing aligned with said plow front surface except when said plow wing is in said extended and forwardly angled positions.

35. The plow assembly of claim 34 wherein each of said housings includes a latch release opening which allow said respective latch members to pivot away from said latch surface to release said hinge and plow wing when in said extended position.

36. The plow assembly of claim 33 wherein said power source includes a pair of extendable fluid power cylinders, each cylinder having two ends, one end of each fluid cylinder being pivotally connected to said rear surface of said plow, the other end of each fluid cylinder being pivotally connected to a respective one of said hinges.

37. The plow assembly of claim 36 wherein each of said hinges is pivotally connected to its respective slide along a generally vertical pivot axis; said other end of each of said fluid cylinders being pivotally connected to said respective hinge at a distance from said pivot axis.

38. The plow assembly of claim 36 wherein said slides are aligned with one another along a common axis for extension and retraction; said fluid cylinders overlapping one another on said rear surface of said plow.

39. The plow assembly of claim 28 wherein the vehicle has a longitudinal axis generally aligned with the direction of motion of the vehicle when traveling in forward or reverse; said support including a support frame for attaching said plow to the front of the vehicle; said plow being pivotally mounted on said support frame for movement about a first, generally vertical pivot axis from a centered position extending generally transverse to the longitudinal axis of the vehicle to a series of angled positions in which said plow is angled to the left or right of said centered position.

40. The plow assembly of claim 39 wherein said plow is pivotally connected to said support frame about a second, generally horizontal pivot axis to allow forward pivotal movement of said plow and plow wings in unison when at least one of said plow and plow wings encounter an obstacle during plowing.

41. The plow assembly of claim 40 including an intermediate support extending between said plow and support frame, said intermediate support connected to said support frame about said first pivot axis and connected to said rear surface of said plow on said second pivot axis.

42. The plow assembly of claim 41 including biasing means extending between said plow and said intermediate support for urging said plow and plow wings into an upright, generally vertically oriented position about said second pivot axis.

43. The plow assembly of claim 41 including a shock absorber extending between said plow and said intermediate section for dampening pivotal movement of said plow and plow wings about said second pivot axis.

44. The plow assembly of claim 41 including at least one extendable fluid power cylinder for pivotally moving said plow, plow wings and intermediate section about said first pivot axis, said fluid power cylinder having two ends, one end pivotally connected to said support frame, the other end pivotally connected to said intermediate support.

45. The plow assembly of claim 41 wherein said support frame includes a pivot mount defining a third pivot axis spaced from said first and second pivot axes, said third pivot axis adapted to provide a generally horizontal axis for connection to the vehicle to allow lifting said plow and plow wings away from the ground when not in use.

46. The plow assembly of claim 28 wherein each of said first and second plow wings includes a latch assembly which prevents pivotal movement of said respective plow wing to said forwardly angled position until said respective plow wing is in said extended position.

47. The plow assembly of claim 28 wherein said power source includes a pair of extendable fluid power cylinders, each cylinder having two ends, one end of each fluid cylinder being pivotally connected to said rear surface of said plow, the other end of each fluid cylinder being pivotally connected to a respective one of said hinges.

48. The plow assembly of claim 29 wherein said first slide is mounted in a first slide support on said plow, said second slide being mounted in a second slide support on said plow; each of said slide supports including a stop, each of said slides including an aperture, said apertures each having opposing ends, each of said stops engaging one of said aperture ends in its respective aperture when its respective plow wing is in said retracted position, and engaging the other of said aperture ends when its respective plow wing is in said extended position.

49. The plow assembly of claim 48 wherein each of said slide supports includes a housing which surrounds its respective slide, each of said slides being telescopingly mounted in its respective housing.

50. The plow assembly of claim 28 wherein each of said first and second ends of said plow are inclined outwardly to close any gap between said inner ends of said first and second extendable plow wings and said first and second plow ends.

51. A plow assembly for vehicles, such as pickup trucks and utility vehicles, the vehicle having a longitudinal axis generally aligned with the direction of motion of the vehicle when traveling in forward or reverse, said assembly comprising:

a plow having first and second ends, a front material engaging surface, and a rear surface opposite said front surface;

a support frame for attaching said plow to the front of the vehicle, said plow being pivotally mounted on said support frame for movement about a first, generally vertical pivot axis from a centered position extending generally transverse to the longitudinal axis of the vehicle to a series of angled positions in which said plow is angled to the left or right of said centered position;

first and second extendable plow wings, each wing having a cross-sectional contour corresponding to said plow, inner and outer ends, a front, material engaging surface, and a rear surface opposite said front surface; said first wing being mounted for sliding movement along said front surface of said plow at a first of said plow ends, said second wing being mounted for sliding movement along said front surface of said plow at the second of said plow ends, each of said wings being movable between a retracted position in which said outer end of said wing is adjacent its respective end of said plow and an extended position in which said outer wing end is spaced outwardly from its respective end of said plow, each of said wings being generally aligned with said plow front surface when in said extended position;

each plow wing also including a hinge and being pivotally mounted on said hinge for movement between said extended position and a forwardly angled position in which said wing front surface extends at an angle to said plow front surface;

first and second slides mounted on said plow, said first plow wing and hinge mounted on and movable with said first slide, said second plow wing and hinge mounted on and movable with said second slide;

said plow including first and second openings extending through said front material engaging surface, said first slide being slidably mounted on said rear surface of said plow in alignment with said first opening with said first hinge extending through said first opening for pivotally mounting said first plow wing; said second slide being slidably mounted on said rear surface of said plow in alignment with said second slide with said second hinge extending through said second opening for pivotally mounting said second plow wing; each of said slides including a wall covering said respective first or second opening when said plow wing is in said extended position and said forwardly angled position such that said openings through said front material engaging surface of said plow are closed with said plow wings extended and forwardly angled;

a power source operable to move each of said plow wings independently of the other plow wing such that said plow wings are independently movable between said respective, retracted, extended, and forwardly angled positions.

* * * * *

UNITED STATES PATENT AND TRADEMARK OFFICE

CERTIFICATE OF CORRECTION

PATENT NO. : 5,638,618
DATED : June 17, 1997
INVENTOR(S) : Cal G. Niemela et al.

It is certified that error appears in the above-identified patent and that said Letters Patent is hereby corrected as shown below:

Column 2, line 40:
"from " should be --front--

Column 7, line 28:
"range" should be --flange--

Signed and Sealed this

Twenty-ninth Day of June, 1999

*Attest:*

Q. TODD DICKINSON

*Attesting Officer*

*Acting Commissioner of Patents and Trademarks*